US007038384B2

(12) United States Patent
Horiuchi et al.

(10) Patent No.: US 7,038,384 B2
(45) Date of Patent: May 2, 2006

(54) HIGH PRESSURE DISCHARGE LAMP, METHOD FOR PRODUCING THE SAME AND LAMP UNIT

(75) Inventors: Makoto Horiuchi, Nara (JP); Tsuyoshi Ichibakase, Osaka (JP); Kiyoshi Takahashi, Kyoto (JP); Shinichiro Hataoka, Osaka (JP); Tomoyuki Seki, Osaka (JP); Takashi Tsutatani, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 228 days.

(21) Appl. No.: 10/756,105

(22) Filed: Jan. 13, 2004

(65) Prior Publication Data

US 2004/0140769 A1 Jul. 22, 2004

(30) Foreign Application Priority Data

Jan. 14, 2003 (JP) ..... 2003-006145

(51) Int. Cl.
*H01J 17/02* (2006.01)

(52) U.S. Cl. ..... 313/623; 313/626

(58) Field of Classification Search ..... 313/623–626
See application file for complete search history.

(56) References Cited

U.S. PATENT DOCUMENTS

| | | | | |
|---|---|---|---|---|
| 5,109,181 | A | 4/1992 | Fischer et al. | |
| 5,374,872 | A * | 12/1994 | Balaschak et al. | 313/623 |
| 6,232,719 | B1 | 5/2001 | Kaneko et al. | |
| 2005/0017643 | A1 * | 1/2005 | Hendrix et al. | 313/626 |

FOREIGN PATENT DOCUMENTS

| | | |
|---|---|---|
| EP | 1 225 614 A1 | 7/2002 |
| JP | 2-148561 | 6/1990 |
| JP | 4-229942 | 8/1992 |
| JP | 2001-23570 | 1/2001 |

* cited by examiner

*Primary Examiner*—Vip Patel
(74) *Attorney, Agent, or Firm*—Harness, Dickey & Pierce, P.L.C.

(57) ABSTRACT

The formation step of a sealing portion 2 includes the substeps of inserting, into the side tube portion 2', a glass member 70 made of a second glass having a softening point lower than that of a first glass constituting the side tube portion 2'; tightly attaching forward and backward portions (A and C) of the glass member 70 to the side tube portion 2' by heating the side tube portion 2' when the glass member 70 is divided into the forward portion, the backward portion, and a central portion under the assumption that the side of the glass member 70 closer to a luminous bulb portion 1' is the forward side, thereby forming a cavity 30 between at least a portion of the central portion (B) and the side tube portion 2'; and heating, after the attachment step, a portion including at least the glass member 70 and the side tube portion 2' at a temperature higher than the strain point temperature of the second glass.

12 Claims, 16 Drawing Sheets

Compressive stress remains

HIGH PRESSURE DISCHARGE LAMP, METHOD FOR PRODUCING THE SAME AND LAMP UNIT

BACKGROUND OF THE INVENTION

1. Field of the Invention

The present invention relates to methods for producing a high pressure discharge lamp, and to high pressure discharge lamps and lamp units. In particular, the present invention relates to methods for producing a high pressure discharge lamp used for general illumination, a projector or an automobile headlight in combination with a reflecting mirror, or the like.

2. Description of the Related Art

In recent years, an image projecting apparatus such as a liquid crystal projector and a DMD (Digital Micromirror Device) projector has been commonly used as a system for realizing large-scale video images, and in general, a high pressure discharge lamp having a high intensity has been commonly used for such an image projecting apparatus. FIG. 11 is a schematic view showing the structure of a conventional high pressure discharge lamp 1000. The lamp 1000 shown in FIG. 11 is a so-called ultrahigh pressure mercury lamp, which is disclosed, for example, in Japanese Unexamined Patent Publication No. 2-148561.

The lamp 1000 includes a luminous bulb (arc tube) 101 made of quartz glass and a pair of sealing portions (seal portions) 102 extending from both ends of the luminous bulb 101. A luminous material (mercury) 106 is enclosed inside (in a discharge space) of the luminous bulb 101, and a pair of tungsten electrodes (W electrodes) 103 made of tungsten are opposed with a predetermined distance. A molybdenum foil (Mo foil) 104 in the sealing portion 102 is welded to one end of the W electrode 103, and the W electrode 103 and the Mo foil 104 are electrically connected to each other. An external lead (Mo rod) 105 made of molybdenum is electrically connected to one end of the Mo foil 104. Argon (Ar) and a small amount of halogen, in addition to the mercury 106, are enclosed in the luminous bulb 101.

The operational principle of the lamp 1000 will be briefly described below. When a start voltage is applied between the W electrodes 103 via the external leads 105 and the Mo foils 104, discharge of argon (Ar) occurs. This discharge increases the temperature in the discharge space of the luminous bulb 101, and then the mercury 106 is heated and evaporated. Therefore, mercury atoms are exited in the central portion of an arc between the W electrodes 103 and thus light is emitted. The higher the mercury vapor pressure of the lamp 1000 is, the more light is radiated, so that the lamp with a higher mercury vapor pressure is more suitable for the light source of an image projecting apparatus. However, in view of the physical strength of the luminous bulb 110 against pressure, the lamp 1000 is used at a mercury vapor pressure of 15 to 20 MPa (150 to 200 atm).

SUMMARY OF THE INVENTION

The conventional lamp 1000 described above has a strength against a pressure of about 20 MPa. In order to further improve the lamp characteristics, research and development aiming to further enhance the strength of the lamp against pressure is conducted (e.g., see Japanese Unexamined Patent Publication No. 2001-23570). This is because there is a demand for a higher output and power lamp to realize a higher performance image projecting apparatus, and thus there is a demand for a lamp having a higher strength against pressure in order to meet this demand.

Further describing this point, in the case of a high output and power lamp, in order to suppress a rapid evaporation of the electrodes by an increase in current, it is necessary to enclose a higher amount of mercury than usual to increase the lamp voltage. If the amount of mercury enclosed is insufficient relatively to the lamp power, the lamp voltage cannot be increased to a necessary level, resulting in a lamp current increase. As a result, the electrodes are evaporated in a short time, and therefore a practical lamp cannot be achieved. In other words, what should be done in order to realize a high power lamp is only to increase the lamp power and to produce a short-arc type lamp whose interelectrode distance is shorter than that of a conventional lamp. However, in order to produce a high output and high power lamp in practice, it is necessary to improve the strength against pressure to increase the amount of mercury enclosed. Current techniques have not succeeded in realizing a high pressure discharge lamp having a very high strength against pressure (e.g., about 30 MPa or more) that can be used in practice.

The inventors successfully developed a high pressure discharge lamp having an extremely high strength against pressure (e.g., about 30 MPa or more) as disclosed in Japanese Patent Application No. 2002-351524. However, the inventors have found that even such an excellent lamp can be further improved by modifying a producing method thereof.

Therefore, with the foregoing in mind, it is a main object of the present invention to provide a more effective method for producing a high pressure discharge lamp having high strength against pressure. Another object of the present invention is to provide a high pressure discharge lamp having extremely high strength against pressure and good starting capability.

A method for producing a high pressure discharge lamp according to the present invention is one for producing a high pressure discharge lamp comprising a luminous bulb enclosing a luminous substance inside and a sealing portion for retaining the airtightness of the luminous bulb. This method comprises the steps of: preparing a glass pipe for a discharge lamp including a luminous bulb portion that will be formed into a luminous bulb of a high pressure discharge lamp and a side tube portion extending from the luminous bulb portion; and forming the sealing portion from the side tube portion. In this method, the formation step of the sealing portion comprises: an insertion substep of inserting, into the side tube portion, a glass member made of a second glass having a softening point lower than that of a first glass constituting the side tube portion; an attachment substep of tightly attaching a forward portion and a backward portion of the glass member to the side tube portion by heating the side tube portion, thereby forming a cavity between at least a portion of a central portion of the glass member and the side tube portion, the glass member being divided into the forward portion, the backward portion, and the central portion positioned between the forward portion and the backward portion under the assumption that the side of the glass member closer to the luminous bulb portion is the forward side; and a heating substep of heating, after the attachment substep, a portion including at least the glass member and the side tube portion at a temperature higher than the strain point temperature of the second glass.

In one preferred embodiment, the heating substep is performed at a temperature lower than the strain point temperature of the first glass.

Another method for producing a high pressure discharge lamp according to the present invention is one for producing a high pressure discharge lamp comprising a luminous bulb enclosing a luminous substance inside and a pair of sealing portions extending from both ends of the luminous bulb. This method comprises the steps of: preparing a glass pipe for a discharge lamp including a luminous bulb portion that will be formed into a luminous bulb of a high pressure discharge lamp and a pair of side tube portions extending from both ends of the luminous bulb portion; inserting, into one of the pair of side tube portions, a glass tube made of a second glass having a softening point lower than that of a first glass constituting the side tube portion and an electrode structure including at least an electrode rod; and tightly attaching a forward portion and a backward portion of the glass tube to one said side tube portion by heating and shrinking (contracting) one said side tube portion, thereby forming one of the pair of sealing portions in which a cavity is provided between at least a portion of a central portion of the glass tube and one said side tube portion, the glass tube being divided into the forward portion, the backward portion, and the central portion positioned between the forward portion and the backward portion under the assumption that the side of the glass tube closer to the head of the electrode rod is the forward side.

In one preferred embodiment, another production method further comprises the steps of: introducing a luminous substance into the luminous bulb portion after one said sealing portion is formed; inserting, after one said sealing portion is formed, a glass tube made of the second glass having a softening point lower than that of the first glass constituting the other of the pair of side tube portions and an electrode structure including at least an electrode rod into the other said side tube portion, tightly attaching a forward portion and a backward portion of the glass tube to the other said side tube portion by heating and shrinking (contracting) the other said side tube portion, thereby forming the other of the pair of sealing portions in which a cavity is provided between at least a portion of a central portion of the glass tube and the other said side tube portion, the glass tube being divided into the forward portion, the backward portion, and the central portion positioned between the forward portion and the backward portion under the assumption that the side of the glass tube closer to the head of the electrode rod is the forward side; and heating a portion of a lamp assembly resulting from the formation of both the sealing portions and the luminous bulb at a temperature higher than the strain point temperature of the second glass and lower than the strain point temperature of the first glass, the portion of the lamp assembly including at least the glass tube and the side tube portion.

The heating step or substep can be performed for 2 hours or more.

In one preferred embodiment, the heating step or substep is performed for 100 hours or more.

In one preferred embodiment, the heating step or substep is performed so that when the sealing portion is measured by a sensitive color plate method utilizing a photoelastic effect, a compressive stress of from 10 kgf/cm$^2$ to 50 kgf/cm$^2$ inclusive in the longitudinal direction of the side tube portion is present in a region of the sealing portion made of the second glass.

In one preferred embodiment, the compressive stress is generated in each of the pair of sealing portions.

In one preferred embodiment, the electrode structure includes the electrode rod, a metal foil connected to the electrode rod, and an external lead connected to the metal foil, and the longitudinal dimension of the glass tube is greater than the longitudinal dimension of the metal foil.

In one preferred embodiment, the first glass contains 99 wt % or more of $SiO_2$, and the second glass contains $SiO_2$ and at least one of 15 wt % or less of $Al_2O_3$ and 4 wt % or less of B.

In one preferred embodiment, the high pressure discharge lamp is a high pressure mercury lamp, and the high pressure discharge lamp encloses, as the luminous substance, mercury in an amount of 150 mg/cm$^3$ or more based on the internal volume of the luminous bulb.

A high pressure discharge lamp of the present invention comprises: a luminous bulb enclosing a luminous substance inside; and a sealing portion for retaining the airtightness of the luminous bulb. The sealing portion has a first glass portion extending from the luminous bulb and a second glass portion provided at least in a portion of the inside of the first glass portion. The sealing portion further has a portion to which a compressive stress is applied. A cavity is formed in a portion of the boundary between the first glass portion and the second glass portion in the sealing portion.

Another high pressure discharge lamp of the present invention comprises: a luminous bulb enclosing a luminous substance inside; and a pair of sealing portions for retaining the airtightness of the luminous bulb. Each of the pair of sealing portions has a first glass portion extending from the luminous bulb and a second glass portion provided at least in a portion of the inside of the first glass portion. Each of the pair of sealing portions further has a portion to which a compressive stress is applied. A pair of electrode rods are opposed in the luminous bulb. Each of the pair of electrode rods is connected to a metal foil. The metal foil is provided in the sealing portion and at least a connection portion of the metal foil to the electrode rod is positioned in the second glass portion. When the second glass portion is divided into a forward portion, a backward portion, and a central portion positioned between the forward portion and the backward portion under the assumption that the side of the second glass portion closer to the head of the electrode rod is the forward side, a cavity containing at least a rare gas is formed in a boundary portion between at least a portion of the central portion of the second glass portion and the first glass portion.

In one preferred embodiment, when the sealing portion is measured by a sensitive color plate method utilizing a photoelastic effect, a portion to which a compressive stress is applied is present at least in a region of the sealing portion made of the second glass, and the compressive stress value in the longitudinal direction of the side tube portion is from 10 kgf/cm$^2$ to 50 kgf/cm$^2$ inclusive.

In one preferred embodiment, the second glass portion covers the entire metal foil.

In one preferred embodiment, the first glass contains 99 wt % or more of $SiO_2$, and the second glass contains $SiO_2$ and at least one of 15 wt % or less of $Al_2O_3$ and 4 wt % or less of B.

In one preferred embodiment, the high pressure discharge lamp is a high pressure mercury lamp, and mercury is enclosed as the luminous substance in an amount of 150 mg/cm$^3$ or more based on the internal volume of the luminous bulb.

It is preferable that an antenna of conductive material is disposed around a portion of the sealing portion including the cavity.

A lamp unit of the present invention comprises the high pressure discharge lamp and a reflecting mirror for reflecting light emitted from the high pressure discharge lamp.

In one embodiment, mercury is enclosed as the luminous substance in an amount of 220 mg/cm$^3$ or more based on the internal volume of the luminous bulb.

In one embodiment, mercury is enclosed as the luminous substance in an amount of 300 mg/cm$^3$ or more based on the internal volume of the luminous bulb.

In one embodiment, the luminous bulb is tipless.

In one embodiment, the luminous bulb encloses mercuric bromide ($HgBr_2$) as halogen precursor to be decomposed into halogen.

In one embodiment, the electrode structure includes the electrode rod, a metal foil connected to the electrode rod, and an external lead connected to the metal foil.

It is preferable that a metal film made of at least one metal selected from the group consisting of platinum (Pt), iridium (Ir), rhodium (Rh), ruthenium (Ru), and rhenium (Re) is formed at least in a portion of the electrode rod.

In one embodiment, a coil having, at least on its surface, at least one metal selected from the group consisting of Pt, Ir, Rh, Ru, and Re is wound around at least in a portion of the electrode rod.

In one embodiment, a portion having a small diameter in which an inner diameter of the side tube portion is smaller than that of other portions is provided in a vicinity of a boundary of the side tube portion and the luminous bulb portion in the glass pipe for a discharge lamp.

A high pressure discharge lamp in one embodiment includes a luminous bulb enclosing a luminous substance therein; and a sealing portion for retaining the airtightness of the luminous bulb. The sealing portion has a first glass portion extending from the luminous bulb and a second glass portion provided at least in a portion of the inside of the first glass portion. When a strain measurement is performed by a sensitive color plate method utilizing a photoelastic effect is performed, a compressive stress is observed at least in a portion of a region of the sealing portion corresponding to the second glass portion.

The strain measurement can be performed with a strain detector of SVP-200 manufactured by Toshiba Cooperation.

With the present invention, a cavity is formed between a side tube portion and at least a portion of a central portion of a glass member, so that tearing of a metal foil can be prevented. Moreover, where at least a rare gas is contained in the cavity, an antenna is disposed around a portion of a sealing portion including the cavity, whereby the starting voltage of a high pressure discharge lamp can be decreased.

DETAILED DESCRIPTION OF THE PREFERRED EMBODIMENTS

Prior to description of embodiments of the present invention, a description will first be made of high pressure mercury lamps with an extremely high strength against pressure which have an operation pressure of about 30 to 40 MPa or higher (about 300 to 400 atm or higher). Note that the details of these high pressure mercury lamps as well as the mechanism by which strain is created in a sealing portion of the lamp are disclosed in U.S Patent Application Publication No. 2003/0168980 A1, the contents of which are incorporated herein by reference.

Figure 1A:
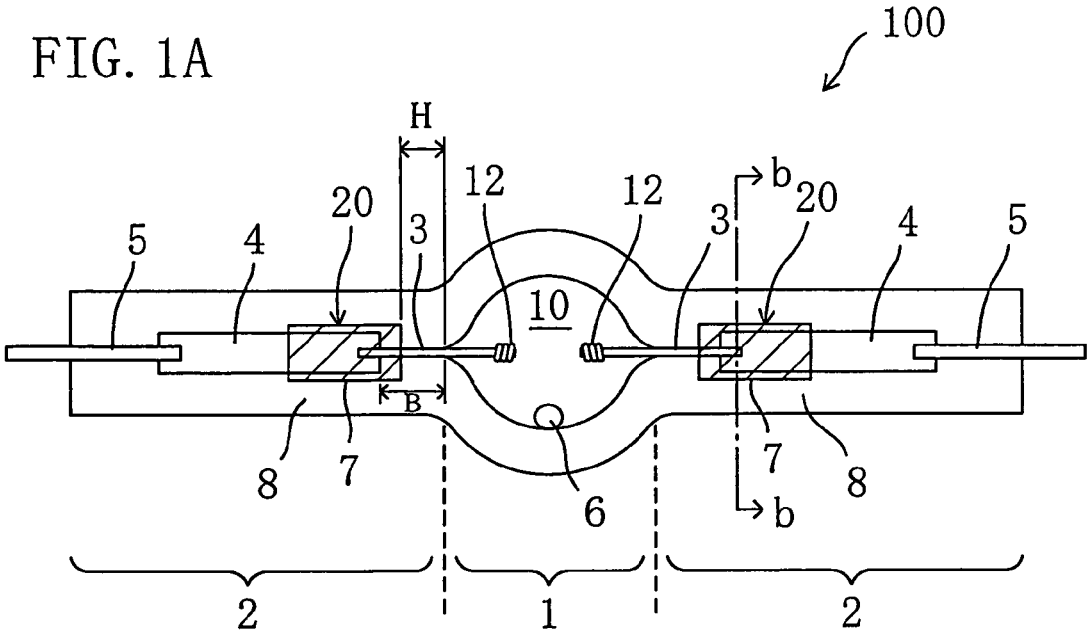
FIGS. 1A and 1B are schematic cross-sectional views showing the structure of a high pressure discharge lamp 100.
Figure 1B:
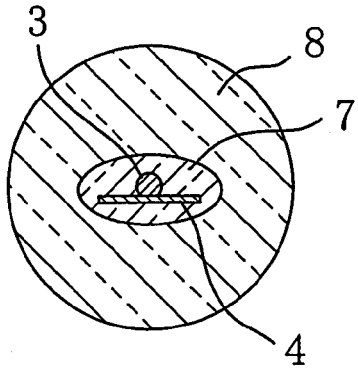

It was very tough work to develop a practically usable high pressure mercury lamp even with an operation pressure of about 30 MPa or higher. However, for example, by applying a structure shown in FIG. 1 to the lamp, the inventors successfully attained a lamp with extremely high withstand pressure. FIG. 1B is a cross-sectional view take along the line b—b of FIG. 1A.

A high pressure discharge lamp (for example, a high or ultrahigh pressure mercury lamp) 100 shown in FIG. 1 is disclosed in U.S Patent Application Publication No. 2003/0168980 A1. The lamp 100 includes a luminous bulb 1 and a pair of sealing portions 2 for retaining the airtightness of the luminous bulb 1. At least one of the sealing portions 2 includes a first glass portion 8 extending from the luminous bulb 1 and a second glass portion 7 provided at least in a portion of the inside of the first glass portion 8. One said sealing portion 2 has a portion (20) to which a compressive stress is applied.

The compressive stress applied to a portion of the sealing portion 2 can be substantially beyond zero (i.e., 0 kgf/cm$^2$). The presence of the compressive stress can improve the strength against pressure as compared to the conventional structure. It is preferable that the compressive stress is about 10 kgf/cm$^2$ or more, (about $9.8\times10^5$ N/m$^2$ or more) and about 50 kgf/cm$^2$ or less, (about $4.9\times10$ N/m$^2$ or less). When it is less than 10 kgf/cm$^2$, the compressive strain is so weak that the strength of the lamp against pressure may not be increased sufficiently. Moreover, there is no practical glass material that can realize a structure having a compressive stress higher than about 50 kgf/cm$^2$. However, a compressive stress of less than 10 kgf/cm$^2$ can increase the strength against pressure as compared to the conventional structure as long as it exceeds substantially zero. If a practical material that can realize a structure having a compressive stress of more than 50 kgf/cm$^2$ is developed, the second glass portion 7 can have a compressive stress of more than 50 kgf/cm$^2$.

The first glass portion 8 in the sealing portion 2 contains 99 wt % or more of silica ($SiO_2$), and is made of, for example, quartz glass. On the other hand, the second glass portion 7 contains $SiO_2$ and at least one of 15 wt % or less of alumina ($Al_2O_3$) and 4 wt % or less of boron (B), and is made of, for example, Vycor glass. When $Al_2O_3$ or B is added to $SiO_2$, the glass softening point is decreased. Therefore, the softening point of the second glass portion 7 is lower than that of the first glass portion 8. As can be seen, the total amount of $Al_2O_3$ and B contained in the second glass portion 7 is preferably more than 1 wt % to decrease the softening point of the second glass portion 7. The Vycor glass (product name) is glass obtained by mixing additives in quartz glass to decrease the softening point so as to improve the processability of quartz glass. For example, the Vycor glass can be produced by subjecting borosilicate glass to a thermal and chemical treatment to have the characteristics similar to those of quartz. An exemplary composition of the Vycor glass is as follows: 96.5 wt % of silica ($SiO_2$); 0.5 wt % of alumina ($Al_2O_3$); and 3 wt % of boron (B). In this embodiment, the second glass portion 7 is formed of a glass tube made of Vycor glass. The glass tube made of Vycor glass can be replaced by a glass tube containing 62 wt % of $SiO_2$, 13.8 wt % of $Al_2O_3$, and 23.7 wt % of CuO.

An electrode rod 3 one end of which is positioned in the discharge space is connected by welding to a metal foil 4 provided in the sealing portion 2, and at least a part of the metal foil 4 is positioned in the second glass portion 7. In the structure shown in FIG. 1, a portion including a connection portion of the electrode rod 3 with the metal foil 4 is covered with the second glass portion 7. As shown in FIG. 1B, in a transverse cross section of the sealing portion 2 (a cross section of the sealing portion 2 intersecting perpendicularly to the longitudinal direction thereof), all sides of the metal foil 4 are covered with the second glass portion 7. Thus, all sides of at least a portion of the metal foil 4 which viewed in its transverse cross section are covered with the second glass portion 7. In this portion, all edges of the metal foil 4 are covered with the second glass portion 7. Exemplary sizes of the second glass portion 7 in the structure shown in FIG. 1 are as follows. The length of the sealing portion 2 in the longitudinal direction is about 2 to 20 mm (e.g., 3 mm, 5 mm and 7 mm), and the thickness of the second glass portion 7 interposed between the first glass portion 8 and the metal foil 4 is about 0.01 to 2 mm (e.g., 0.1 mm). The distance H from the end face of the second glass portion 7 on the side of the luminous bulb 1 to a discharge space 10 of the luminous bulb 1 is about 0 mm to about 6 mm (e.g., 0 mm to about 3 mm or 1 mm to 6 mm). When the second glass portion 7 is not desired to be exposed into the discharge space 10, the distance H is larger than 0 mm, and for example, 1 mm or more. The distance B from the end face of the metal foil 4 on the side of luminous bulb 1 to the discharge space 10 of the luminous bulb 1 (in other words, the length of the portion of the electrode rod 3 that is buried alone in the sealing portion 2) is, for example, about 3 mm.

Figure 2A:
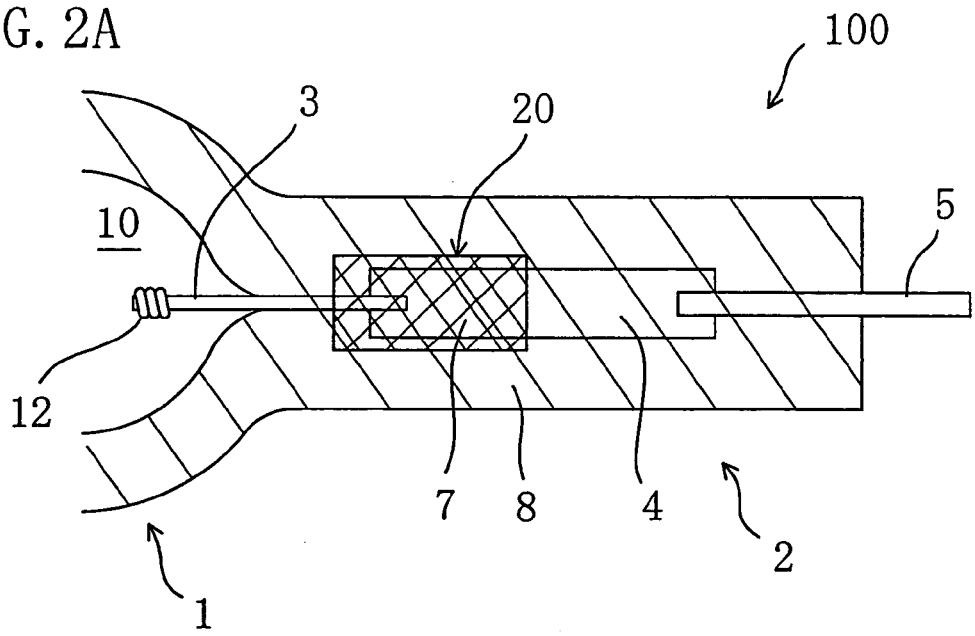
FIGS. 2A and 2B are enlarged views of the principal part showing the distribution of compressive strain along the longitudinal direction (electrode axis direction) of a sealing portion 2.
Figure 2B:
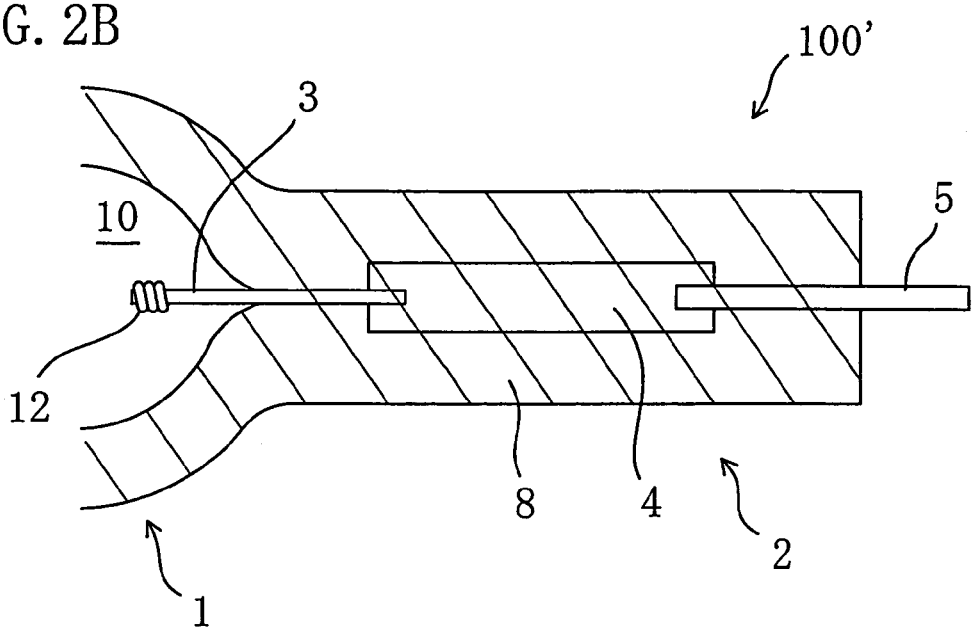

Next, the compressive strain in the sealing portion 2 will be described. FIGS. 2A and 2B are schematic views showing the distribution of the compressive strain along the longitudinal direction (direction of the electrode axis) of the sealing portion 2. FIG. 2A shows the distribution in the structure of the lamp 100 provided with the second glass portion 7, and the FIG. 2B shows the distribution in the structure of the lamp 100' that is not provided with the second glass portion 7 (comparative example).

In the sealing portion 2 shown in FIG. 2A, a compressive stress (compressive strain) is present in a region (cross-hatched region) corresponding to the second glass portion 7, and the magnitude of compressive stress in the portion (hatched region) of the first glass portion 8 is substantially zero. On the other hand, as shown in FIG. 2B, in the case of the sealing portion 2 not provided with the second glass portion 7, there is no portion in which a compressive strain is locally present, and the magnitude of compressive stress on the first glass portion 8 is substantially zero.

The inventors actually measured the strain within the lamp 100 quantitatively, and observed that a compressive stress is present in the second glass portion 7 in the sealing portion 2. This quantification of the strain was performed using a sensitive color plate method utilizing a photoelastic effect. A measuring device for quantifying a strain is a strain detector (SVP-200 manufactured by Toshiba Corporation), and when this strain detector is used, the magnitude of compressive strain on the sealing portion 2 can be obtained as an average of the stress applied to the sealing portion 2.

The principle of the strain measurement by the sensitive color plate method utilizing a photoelastic effect will be described briefly with reference to FIG. 12. FIGS. 12A and 12B are schematic views showing the state in which linearly polarized light obtained by transmitting light through a polarizing plate is incident to glass. Herein, when the vibration direction of the linearly polarized light is taken as u, u can be regarded as being obtained by synthesizing u1 and u2.

Figure 12A:
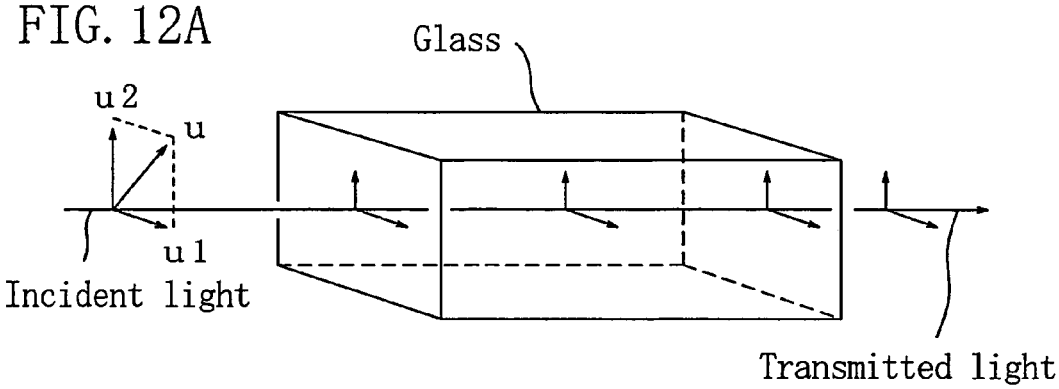
FIGS. 12A and 12B are drawings for explaining the principle of the measurement of strain by a sensitive color plate method utilizing a photoelastic effect.
Figure 12B:
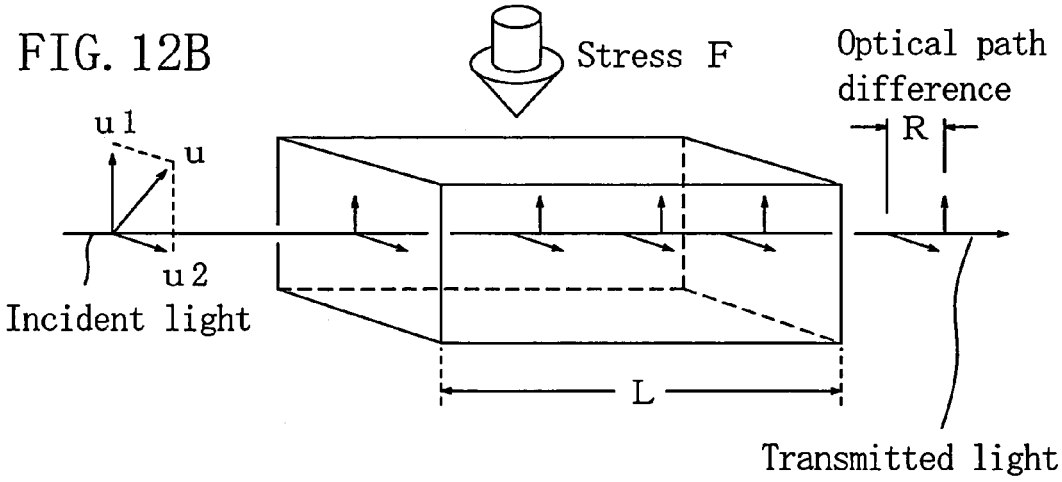

As shown in FIG. 12A, if there is no strain in the glass, u1 and u2 are transmitted through it at the same speed. Therefore, no displacement of the transmitted lights u1 and u2 occurs. On the other hand, as shown in FIG. 12B, if there is a strain in the glass and a stress F is applied thereto, u1 and u2 are not transmitted through it at the same speed, so that an offset of the transmitted lights u1 and u2 occurs. In other words, one of u1 and u2 is later than the other. The distance of this difference made by being late is referred to as an optical path difference. Since the optical path difference R is proportional to the stress F and the distance of light transmission through the glass L, the optical path difference R can be expressed as $$R=C\cdot F\cdot L$$

where C is a proportional constant. The unit of each letter is as follows: R (nm); F (kgf/cm$^2$); L (cm); and C ({nm/cm}/{kgf/cm$^2$}). C is referred to as "photoelastic constant" and depends on the materials used such as glass. As seen from the above equation, if C is known, L and R can be measured to obtain F.

The inventors measured the distance L of light transmission in the sealing portion 2, that is, the outer diameter L of the sealing portion 2, and obtained the optical path difference R by observing the color of the sealing portion 2 at the time of measurement with a strain standard. The photoelastic constant of quartz glass, which is 3.5, was used as the photoelastic constant C. These values were substituted in the above equation to calculate the stress value, and the compressive strain in the longitudinal direction of the metal foil 4 was quantified with the calculated stress value.

In this measurement, stress in the longitudinal direction (direction in which the electrode rod 3 extends) of the sealing portion 2 was observed, but this does not mean that there is no compressive stress in other directions. In order to determine whether or not a compressive stress is present in the radial direction (the direction from the central axis toward the outer circumference, or the opposite direction) or the circumferential direction (e.g., the clockwise direction) of the sealing portion 2, it is necessary to cut the luminous bulb 1 or the sealing portion 2. However, as soon as such cutting is performed, the compressive stress in the second glass portion 7 is released. Therefore, only the compressive stress in the longitudinal direction can be measured without cutting the lamp 100. Consequently, the inventors quantified the compressive stress at least in this direction.

In the lamp 100 of this embodiment, a compressive strain (at least compressive strain in the longitudinal direction) is present in the second glass portion 7 provided at least in a portion of the inside of the first glass portion 8, so that the strength of a high pressure discharge lamp against pressure can be improved. In other words, the lamp 100 of this embodiment shown in FIGS. 1 and 2A can have a higher strength against pressure than the comparative lamp 100' shown in FIG. 2B. It is possible to operate the lamp 100 of this embodiment shown in FIG. 1 at an operating pressure of 30 MPa or more, which is more than a highest level of the conventional lamps of about 20 MPa.

Figure 13A:
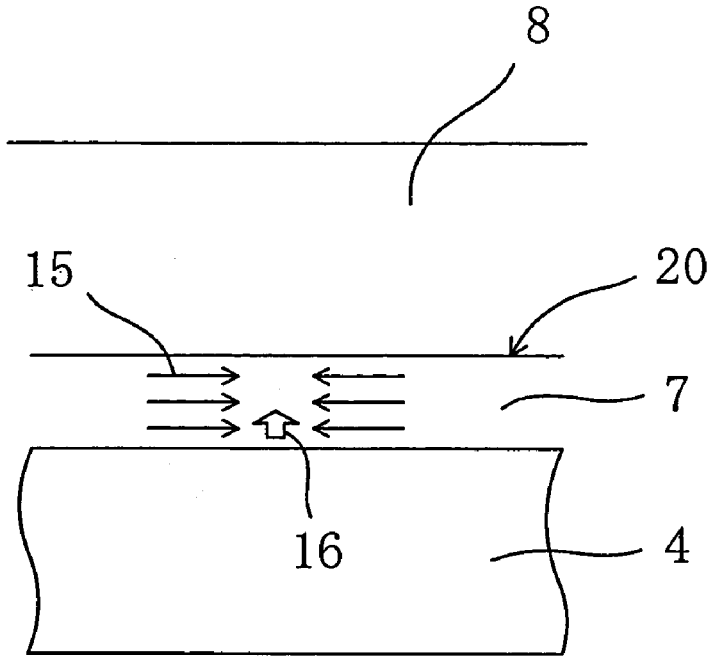
FIGS. 13A and 13B are enlarged views of the principal part of the lamp 100 for explaining the reason why the strength of the lamp 100 against pressure is increased by a compressive strain occurring in a second glass portion.
Figure 13B:
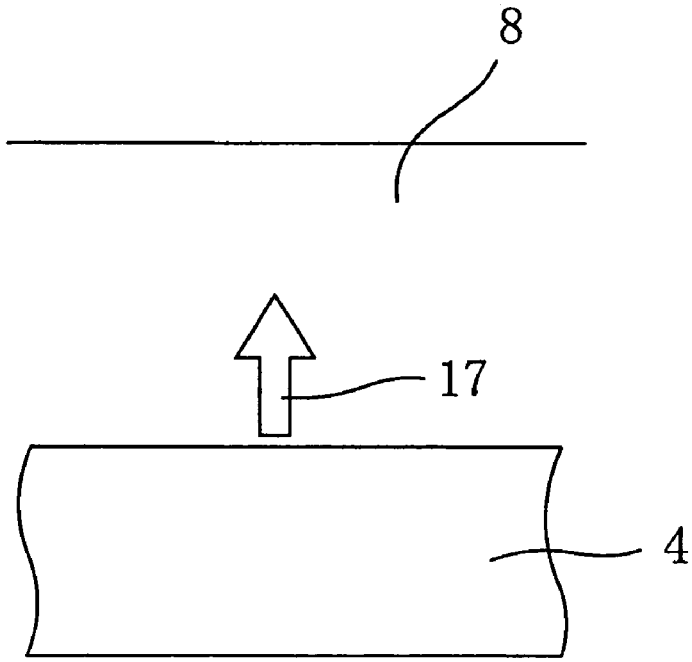

Next, the reason why the strength of the lamp 100 against pressure is increased by the compressive strain in the second glass portion 7 will be described with reference to FIG. 13. FIG. 13A is an enlarged view of the principal part of the sealing portion 2 of the lamp 100, and FIG. 13B is an enlarged view of the principal part of the sealing portion 2 of the comparative lamp 100'.

There are still unclear aspects as to the mechanism that increases the strength of the lamp 100 against pressure, but the inventors inferred as follows.

First, the premise is that the metal foil 4 in the sealing portion 2 is heated and expanded during lamp operation, so that a stress from the metal foil 4 is applied to the glass portion of the sealing portion 2. More specifically, in addition to the fact that the thermal expansion coefficient of metal is larger than that of glass, the metal foil 4 which is thermally connected to the electrode rod 3 and through which current is transmitted is heated more readily than the glass portion of the sealing portion 2. Therefore, stress is applied more readily from the metal foil 4 (in particular, from the side of the foil whose area is small) to the glass portion.

As shown in FIG. 13A, it seems that when a compressive stress is applied in the longitudinal direction of the second glass portion 7, the occurrence of a stress 16 from the metal foil 4 can be suppressed. In other words, it seems that the compressive stress 15 of the second glass portion 7 can suppress the occurrence of the large stress 16. As a result, for example, the possibility of generating cracks in the glass portion of the sealing portion 2 or causing leakage between the glass portion of the sealing portion 2 and the metal foil 4 is reduced, so that the strength of the sealing portion 2 can be improved.

On the other hand, as shown in FIG. 13B, in the case of the structure not provided with the second glass portion 7, it seems that a stress 17 from the metal foil 4 is larger than in the case of the structure shown in FIG. 13A. In other words, it seems that since there is no region to which a compressive stress is applied in the surroundings of the metal foil 4, the stress 17 from the metal foil 4 becomes larger than the stress 16 shown in FIG. 13A. Therefore, it is inferred that the structure shown in FIG. 13A can increase the strength against pressure more than the structure shown in FIG. 13B. This inference is compatible with a general nature of glass in which when a tensile strain (tensile stress) is present in glass, then the glass is easily broken, and when a compressive strain (compressive stress) is present in glass, then the glass is hardly broken.

However, from the general nature of glass in which the presence of a compressive stress in glass makes the glass less breakable, it cannot be inferred that the sealing portion 2 of the lamp 100 has a high strength against pressure. This is because of the following possible inference. Even if the strength of the glass in a region having a compressive strain is increased, a load is assumed to be generated in the sealing portion 2, taken altogether, as compared to the case where there is no strain. The load would in turn reduce the strength of the sealing portion 2 as a whole. However, it was not found until the inventors sampled and studied the lamp 100 that the strength of the lamp 100 against pressure was improved, which could not be derived from only a theory. If a compressive stress larger than necessary remains in the second glass portion 7 (or the vicinity of the outer circumference thereof), the sealing portion 2 may actually be damaged during lamp operation and the life of the lamp may be shortened on the contrary. In view of these, the structure of the lamp 100 having the second glass portion 7 probably exhibits a high strength against pressure under a superb balance between various conditions. Inferring from the fact that the stress and strain of the second glass portion 7 are released when a portion of the luminous bulb 1 is cut, a load due to the stress and strain of the second glass portion 7 may be well received by the entire luminous bulb 1.

It is also inferred that the structure exhibiting a higher strength against pressure is brought about by a portion 20 of the sealing portion 2 to which is applied a compressive stress generated by the difference in the compressive stress between the first glass portion 8 and the second glass portion 7. More specifically, the following inference is possible. There is substantially no compressive stress in the first glass portion 8 and a compressive strain is well confined into a region of only the second glass portion 7 (or the vicinity of the outer circumference) positioned closer to the center than the portion 20 to which a compressive stress is applied. This would succeed in providing excellent withstand pressure characteristics. As a result of the fact that stress values are shown discretely because of the principle of the strain measurement by the sensitive color plate method, the portion 20 to which a compressive stress is applied is distinctly shown in FIG. 13 or other drawings. However, even if actual stress values can be shown continuously, the stress values are believed to change drastically in the portion 20 to which a compressive stress is applied, and it seems that the portion 20 to which a compressive stress is applied can be defined by the region where the stress value changes drastically.

Figure 3:
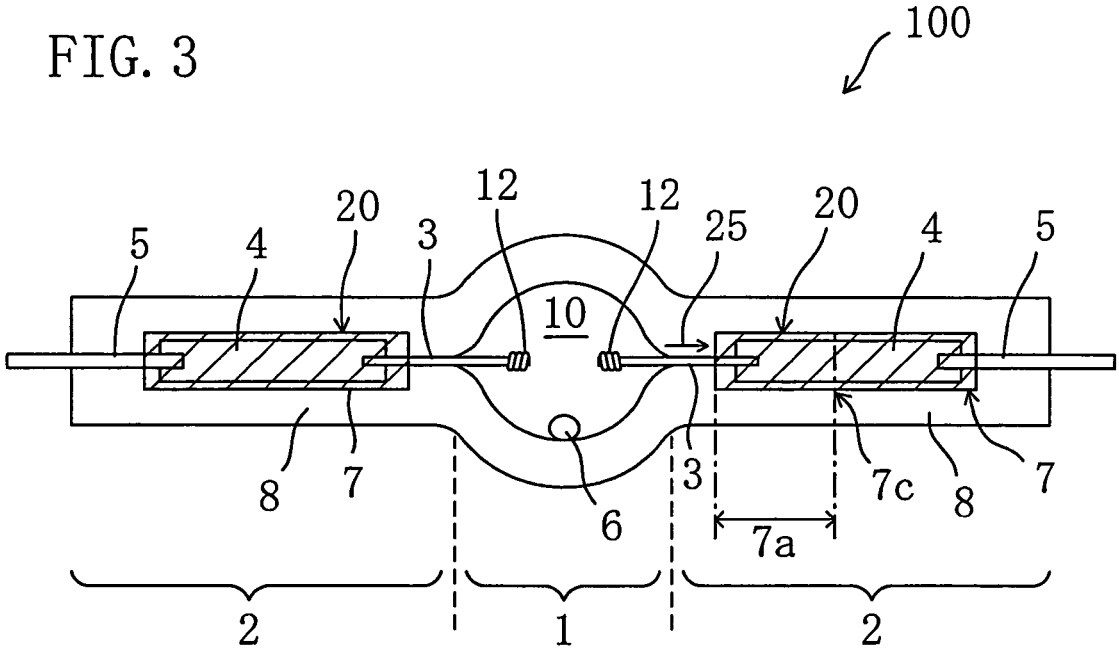
FIG. 3 is a schematic cross-sectional view showing the structure of the high pressure discharge lamp 100.

The second glass portion 7 of the lamp 100 can be disposed to cover the entire metal foil 4 as shown in FIG. 3. However, the inventors have found that such a long second glass portion 7 causes new problems. The problems will be described below.

In the case of the second glass portion 7 capable of covering the entire metal foil 4, its length is about 20 mm, for example. As disclosed in the above-mentioned Japanese Patent Application No. 2002-351524, a compressive strain existing in the second glass portion 7 is placed by mercury vapor pressure within the luminous bulb 1 (the arrow 25). Therefore, a compressive strain is likely to occur in a forward portion 7*a* of the second glass portion 7, while as compared to the forward portion 7*a*, a compressive strain is less likely to occur in a portion thereof at the back of the forward portion 7*a*. Because of this tendency, when viewed from the edge of the luminous bulb 1, a point at which the strain placed on the second glass portion 7 transitions from compressive one to tensile one may appear at a particular position in the second glass portion 7 (for example, 7*c* in FIG. 7). The tensile strain stretches the metal foil 4, and may finally tear the metal foil 4. This phenomenon was observed by the experiments by the inventors. Even if the metal foil 4 is not torn, creases are produced in the metal foil 4, resulting in the occurrence of cracks in the vicinity of a central portion of the sealing portion.

Even in the case where tearing or other action of the metal foil 4 is not caused, if a portion of the metal foil 4 in contact with the transition point (7*c*) is stretched and thinned, the cross-sectional area of that portion becomes small. Therefore, the resistance of that portion increases, which may cause overheating of that portion during lamp power supply and then an abnormal operation of the lamp.

The inventors closely studied how to prevent foil tearing or other problems of the metal foil 4 even with a relatively long second glass portion 7 and then found solutions for this. To be more specific, not a continuous sealing but a discontinuous sealing of the long second glass portion 7 is formed, that is to say, a cavity (a void) is provided in a portion (a central portion) of the boundary between the second glass portion 7 and the first glass portion 8, thereby releasing stress resulting from compressive strain and tensile strain. In this manner, foil tearing or other problems of the metal foil 4 can be prevented. Thus, the present invention has been made.

Hereinafter, embodiments of the present invention will be described with reference to the accompanying drawings. In the following drawings, for simplification of description, the elements having substantially the same function bear the same reference numeral. The present invention is not limited to the following embodiments.

First Embodiment

A high pressure discharge lamp according to a first embodiment of the present invention will be described with reference to FIG. 4. The high pressure discharge lamp according to this embodiment has a cavity (void) 30 formed in a portion of the boundary between the second glass portion 7 and the first glass portion 8 in the sealing portion 2. In this point, the lamp in this embodiment differs from the high pressure discharge lamp 100 shown in FIG. 3 having a continuous junction at the boundary between the first glass portion 8 and the second glass portion 7. In the other points, the lamp in this embodiment has a lamp structure basically identical to the lamp structure shown in FIG. 3. Hence, for ease of explanation, the high pressure discharge lamp in this embodiment is also denoted by the reference numeral 100 and items overlapping with those of the structure shown in FIG. 3 (or FIG. 1) will be omitted or simplified.

The lamp 100 in this embodiment is a double-ended type lamp provided with two sealing portions 2. The second glass portion 7 is disposed to cover the entire metal foil 4, but it is sufficient that it is disposed to cover at least a welded portion of the electrode rod 3 to the metal foil 4, thereby reducing the probability of breakage of the lamp even under the condition of an ultrahigh withstand pressure such as 35 MPa. The longitudinal dimension of the second glass portion 7 is, for example, half or more of that of the metal foil 4.

The second glass portion 7 in this embodiment covers a portion of the electrode rod 3 and all sides of a portion of the metal foil 4 buried in the sealing portion 2. As an exemplary dimension of the second glass portion 7 in this embodiment, the length thereof in the longitudinal direction of the sealing portion 2 is about 10 to 30 mm (for example, about 20 mm).

In the sealing portion 2, a portion of the boundary between the first glass portion 8 and the second glass portion 7 is formed with the cavity 30. To be more specific, when a head (12) of the electric rod 3 is assumed to be the forward side, the second glass portion 7 is divided into a forward portion 17*a*, a backward portion 17*c*, and a central portion 17*b* positioned between the forward portion 17*a* and the backward portion 17*c*. In this structure, the boundary between the central portion 17*b* of the second glass portion 7 and the first glass portion 8 is formed with the cavity 30. The formed cavity 30 serves as a buffer portion and allows suppression of the transition from compressive strain to tensile strain. Therefore, tearing, creases or other problems of the metal foil 4 can be prevented.

The forward portion 17*a* has a longitudinal dimension of, for example, about 2 to 10 mm (e.g., 3 mm, 5 mm or 7 mm). The reason why the backward portion 17*c* is also sealed is to prevent air entry from the side of the second glass portion 7 closer to an external lead 5 and to prevent oxidation of the metal foil 4. There is no limitation on the longitudinal dimension of the backward portion 17*c* as long as oxidation of the metal foil 4 can be prevented.

Figure 5:
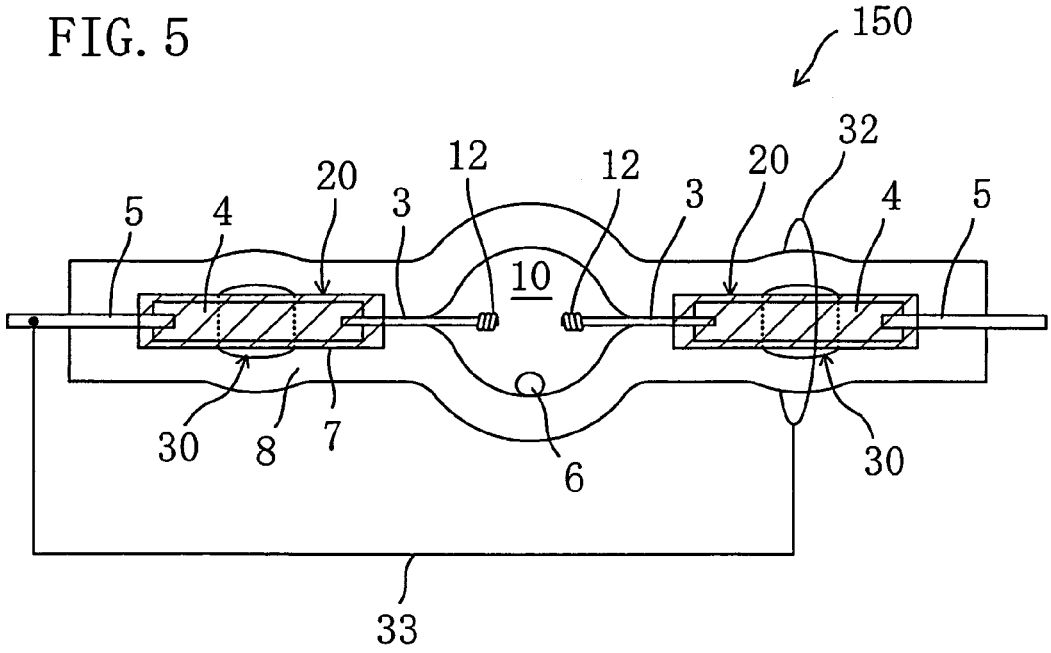
FIG. 5 is a schematic cross-sectional view showing the structure of a high pressure discharge lamp 150 with an antenna.

If at least a rare gas is enclosed within the cavity 30, in other words, if a discharge gas (for example, a rare gas and/or mercury vapor) is enclosed within the cavity 30, as shown in FIG. 5, an antenna 32 is disposed around a portion of the sealing portion 2 including the cavity 30. Then, the starting voltage of the lamp can be decreased. The antenna 32 is made of a wire of conductive material and connected to an interconnect wire 33. In this embodiment, the interconnect wire 33 is connected to the external lead extending from the sealing portion 2 different from the sealing portion 2 at which the antenna 32 is positioned.

Next description will be made of the reason why this structure can decrease the starting voltage of the lamp. In the case of this structure, a portion of the metal foil 4 at which the cavity is present and the antenna 32 provided outside the sealing portion 2 constitute a capacitor. When a high voltage is applied between the antenna 32 and the metal foil 4, extremely weak discharge is generated between the metal foil 4 and the antenna 32 (that is to say, within the cavity 30). Light emitted by this discharge travels through the sealing portion 2 by means of a so-called optical fiber effect and is guided into the luminous bulb 1 (that is to say, into the discharge space 10). As a result, electrons are emitted from the surface of the electrode rod 3, whereby the starting voltage of the lamp is decreased.

The reason for the decrease in the starting voltage will be described more specifically. The discharge generated within the cavity 30 produces ultraviolet rays. The ultraviolet rays flow into the luminous bulb 1 by means of a so-called optical fiber effect and optically excite substances in the luminous bulb 1 (for example, a rare gas) to create seed electrons. This makes it possible to cause dielectric breakdown between the electrodes 3 with a lower voltage at the start of the lamp operation. Consequently, a discharge lamp capable of starting at a low voltage can be attained. For a high pressure discharge lamp 150 shown in FIG. 5, at the start of the lamp when cold (at the cold start), when an open-circuit voltage of 940 V (zero to peak) and a 50 kHz sinusoidal voltage of 5.8 kV are applied between the antenna 32 and the metal foil 4 and between the lamp terminals (the external leads 5), respectively, by a lighting circuit (ballast), the lamp can start at a voltage of 2 kV or lower (for example, 1 to 2 kV). This means that the lamp with the cavity 30 can start at a much lower voltage than the starting voltage of the lamp with no cavity 30 (for example, 10 to 15 kV). The lamp capable of starting at a voltage of 2 kV or lower (for example, 1 to 2 kV) produces an additional effect that a lighting circuit (ballast) can be formed without any transformer. Moreover, since the lamp can start at a low voltage, noises occurring at the start of lamp operation can be reduced.

In the structure of this embodiment shown in FIG. 5, since the metal foil 4 is covered with the second glass portion 7, the metal foil 4 and all edges thereof are not exposed to the cavity 30. If the metal foil 4 is exposed to the cavity 30, discharge generated in the cavity 30 may degrade the metal foil 4 (in particular its edges). However, the lamp structure of this embodiment has no potential for this degradation. Also in this point, the structure of this embodiment is advantageous (for example, to a long life). If the second glass portion 7 is made of Vycor glass, elements such as Na (sodium) in the Vycor glass may facilitate the initiation of discharge within the cavity 30.

Figure 6:
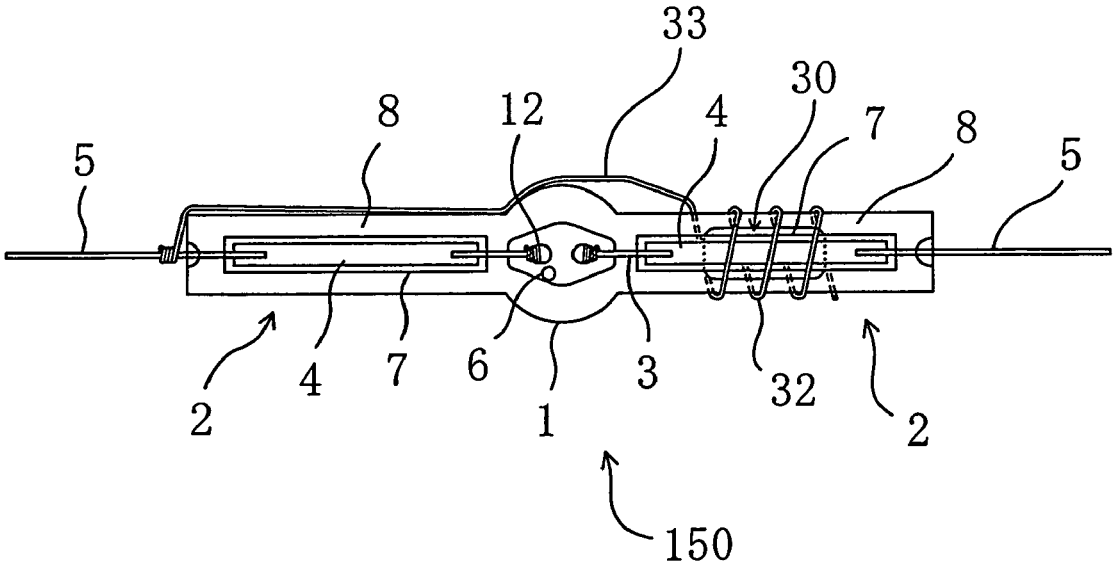
FIG. 6 is a schematic cross-sectional view showing the structure of another high pressure discharge lamp 150 with an antenna.

The shape of the antenna 32 is not limited to a loop as shown in FIG. 5, and it may be a spiral as shown in FIG. 6. The antenna 32 shown in FIG. 6 is formed by winding the interconnect wire 33 around a portion of the sealing portion 2 having the cavity 30. The spiral antenna 32 covers the entire cavity 30, so that the lamp with this structure is provided with an additional advantage that discharge within the cavity 30 can be ensured. Moreover, as shown in FIG. 6, the cavity 30 is not necessarily provided in both the sealing portions 2. Alternatively, the cavity 30 may be provided in either of the sealing portions 2. This is because as long as at least one of the sealing portions 2 is provided with the cavity 30, the lamp reliability can be improved as compared to the lamp structure in which the cavity 30 is not provided in any of the sealing portions 2.

The strength against pressure (operating pressure) of the lamp 100 according to this embodiment can be 20 MPa or more (e.g., about 30 to 50 MPa or more). Moreover, the bulb wall load can be, for example, about 60 W/cm$^2$ or more, and the upper limit is not provided. For example, a lamp having a bulb wall load, for example, in the range from about 60 W/cm$^2$ to about 300 W/cm$^2$ (preferably about 80 to 200 W/cm$^2$) can be realized. If cooling means is provided, a bulb wall load of 300 W/cm$^2$ or more can be achieved. The rated power is, for example, 150 W (the bulb wall load in this case corresponds to about 130 W/cm$^2$).

A detailed description of this embodiment will be made below.

The luminous bulb 1 of the lamp 100 is substantially spherical, and is made of quartz glass as in the case of the first glass portion 8. As shown in FIG. 4, the luminous bulb 1 is designed in a tipless shape. Because of this design, it is necessary to introduce a luminous material 6 not from an opening provided in the luminous bulb 1 but from a side tube portion.

In order to realize a high pressure mercury lamp (in particular, ultrahigh pressure mercury lamp) exerting excellent properties such as a long life, it is preferable to use high purity quartz glass having a low level of alkali metal impurities (e.g., 1 ppm or less of each of Na (sodium), K (potassium) and Li(lithium)) as the quartz glass constituting the luminous bulb 1. It is of course possible to use quartz glass having a regular level of alkali metal impurities. The outer diameter of the luminous bulb 1 is, for example, about 5 mm to 20 mm. The thickness of the glass of the luminous bulb 1 is, for example, about 1 mm to 5 mm. The volume of the discharge space (10) in the luminous bulb 1 is, for example, about 0.01 to 1 cc (0.01 to 1 cm$^3$). In this embodiment, use is made of a luminous bulb 1 having an outer diameter of about 9 mm, an inner diameter of about 4 mm, and a volume of the discharge space of about 0.06 cc.

A pair of electrode rods (electrodes) 3 are opposed in the luminous bulb 1. The heads of the electrode rods 3 are disposed in the luminous bulb 1 with a distance (arc length) of about 0.2 to 5 mm (e.g., 0.6 mm to 1.0 mm), and each of the electrode rods 3 is made of tungsten (W). Use is preferably made of the tungsten electrode rods 3 having a low level of alkali metal impurities (e.g., 1 ppm or less of each of Na, K, and Li) as well, but it is also possible to use the electrode rods 3 having a regular level of alkali metal impurities. A coil 12 is wound around the head of the electrode rod 3 for the purpose of reducing the temperature of the head of the electrode during lamp operation. In this embodiment, a coil made of tungsten is used as the coil 12, but a coil made of thorium-tungsten can be used. Similarly, for the electrode rod 3, not only a tungsten rod, but also a rod made of thorium-tungsten can be used.

Mercury 6 as a luminous material is enclosed in the luminous bulb 1. To operate the lamp 100 serving as an ultrahigh pressure mercury lamp, about at least 200 mg/cc or more (220 mg/cc or more, 230 mg/cc or more, or 250 mg/cc or more), preferably 300 mg or more (e.g., 300 mg/cc to 500 mg/cc) of mercury, and a rare gas (e.g., argon) at 5 to 30 kPa, whose amounts are based on the internal volume of the luminous bulb 1, are enclosed in the luminous bulb 1.

The luminous bulb 1 encloses halogen precursor to be decomposed into halogen. The halogen precursor used herein is $CH_2Br_2$, HBr, $HgBr_2$ or the like. In this embodiment, mercuric bromide ($HgBr_2$) is enclosed as the halogen precursor. Halogen created by decomposing the halogen precursor (that is, bromine (Br)) serves for the halogen cycles that returns W (tungsten) evaporated from the electrodes rod 3 during lamp operation to the electrode rod 3 again. The amount of enclosed $HgBr_2$ is about 0.002 to 0.2 mg/cc. This corresponds to about 0.01 to 1 μmol/cc in terms of the halogen atom density during lamp operation.

An advantage of the use of $HgBr_2$ as halogen precursor is to create Br and Hg by decomposing $HgBr_2$. In other words, the resulting component other than halogen is mercury which is identical to an element having enclosed therein. In this point, $HgBr_2$ differs from the $CH_2Br_2$ or HBr which will create hydrogen (H). Hydrogen possibly combines with halogen again, so that the amount of free halogen may not be fixed because it depends upon the amount of free hydrogen. As disclosed in International Patent Application No. PCT/JP00/04561, halogen contributing to the halogen cycle is always held in the luminous bulb 1 to surely conduct the halogen cycle, whereby the blackening occurring in the luminous bulb 1 can be positively prevented. If it is assumed that an enclosed component decomposes into hydrogen (free hydrogen), however, halogen having combined with the free hydrogen does not always contribute to the halogen cycle. Consequently, the amount of free halogen capable of surely contributing to the halogen cycle is not fixed, so that there is a possibility that the blackening cannot be prevented positively. As a result of the above discussion, $HgBr_2$ is found to be more advantageous because it can eliminate the above possibility and the amount of halogen to be introduced is easily estimated.

In this embodiment, it is preferable that the number of moles of halogen created by the halogen precursor enclosed in the luminous bulb 1 is greater than the sum of the number of moles of all metal elements having the properties of combining with halogen (other than tungsten element and mercury element) and existing in the luminous bulb 1 and the number of moles of tungsten present in the luminous bulb 1 as the result of the evaporation from the electrode 3 during the lamp operation. Thus, halogen contributing to the halogen cycle can always be held in the luminous bulb 1 to surely conduct the halogen cycle. A typical metal element having the properties of combining with halogen is, other than tungsten element and mercury element, alkali metal element (for example, Na, K, and Li).

As described above, the cross-sectional shape of the sealing portion 2 is substantially circular, and the metal foil 4 is provided substantially in the central portion thereof. The metal foil 4 is, for example, a rectangular molybdenum foil (Mo foil), and the width of the metal foil 4 (the length of the shorter side) is, for example, about 1.0 mm to 2.5 mm (preferably, about 1.0 mm to 1.5 mm). The thickness of the metal foil 4 is, for example, about 15 μm to 30 μm (preferably about 15 μm to 20 μm). The radio of the thickness and the width is about 1:100. The length of the metal foil 4 (the length of the longer side) is, for example, about 5 mm to 50 mm.

The external lead 5 is provided by welding on the side of the sealing portion 2 opposite to the side on which the electrode rod 3 is positioned. The external lead 5 is connected to the side of the metal foil 4 opposite to the side to which the electrode rod 3 is connected, and one end of the external lead 5 extends to the outside of the sealing portion 2. The external lead 5 is electrically connected to a ballast circuit (not shown) to electrically connect the ballast circuit to the pair of electrode rods 3. The sealing portion 2 serves to retain the airtightness in the discharge space 10 in the luminous bulb 1 by attaching the glass portions (7, 8) to the metal foil 4 with pressure. The sealing mechanism by the sealing portion 2 will be described briefly below.

The material constituting the glass portion of the sealing portion 2 and molybdenum constituting the metal foil 4 differ in the thermal expansion coefficient. Therefore, in view of the thermal expansion coefficient, the glass portion and the metal foil 4 are not integrated into one unit. However, in the case of this structure (foil sealing), the metal foil 4 is plastically deformed by the pressure from the glass portion of the sealing portion, so that the gap between them can be filled. Thus, the glass portion of the sealing portion 2 and the metal foil 4 can be attached with pressure, and thus the luminous bulb 1 can be sealed with the sealing portion 2. That is to say, by means of foil sealing by pressing the glass portion of the sealing portion 2 against the metal foil 4 to achieve attachment, the sealing portion 2 is sealed. In this embodiment, since the second glass portion 7 having a compressive strain is provided, the reliability of this sealing structure is improved.

In the lamp 100 according to this embodiment, the second glass portion 7, provided at least in a portion of the inside of the first glass portion 8, is subjected to compressive strain (at least in its longitudinal direction), thereby improving the strength of the high pressure discharge lamp against pressure. Moreover, the cavity 30 is formed between the first glass portion 8 and the central portion 17*b* of the second glass portion 7, thereby preventing tearing or other problems of the metal foil 4.

Furthermore, the antenna 32 is provided around the cavity 30, thereby decreasing the starting voltage of the high pressure discharge lamp. The metal foil 4 is not exposed to the cavity 30 in the case, thereby preventing degradation of the metal foil 4.

Figure 4:
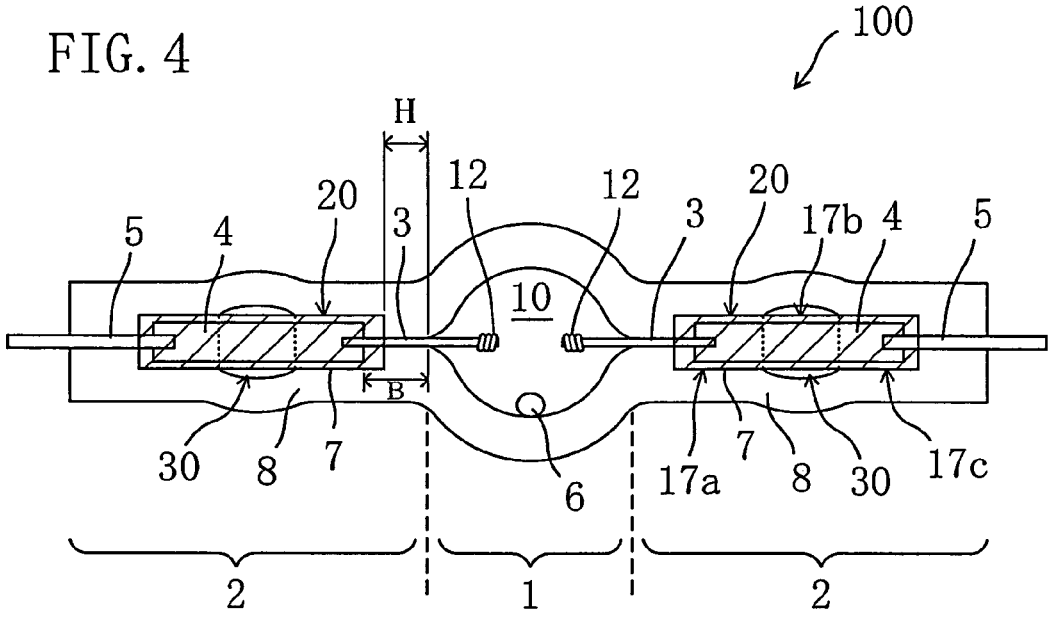
FIG. 4 is a schematic cross-sectional view showing the structure of a high pressure discharge lamp 100 of an embodiment of the present invention.

In the structure shown in FIG. 4, the second glass portion 7 is provided in each of the pair of sealing portions 2, but the present invention is not limited to this structure. Also when the second glass portion 7 is provided in only one of the sealing portions 2, the strength of the lamp 100 against pressure can be higher than that of the comparative lamp 100' shown in FIG. 2B. However, it is preferable that the second glass portion 7 is provided in both the sealing portions 2 and both the sealing portions 2 have a region to which a compressive stress is applied. This is because a higher withstand pressure can be achieved when both the sealing portions 2 have a region to which a compressive stress is applied than when only one of them has the region. That is, in the case where both of two sealing portions have a portion to which a compressive stress is applied, the probability that leakage occurs in either of the sealing portions (i.e., the probability that a withstand pressure of a certain level cannot be maintained) can be ½ of the probability in the case where only one of two sealing portions has a portion to which a compressive stress is applied.

In this embodiment, a high pressure mercury lamp having a very large amount of mercury 6 enclosed (e.g., an ultrahigh pressure mercury lamp having an amount of enclosed mercury of more than 150 $mg/cm^3$) has been described. However, the present invention can be applied preferably to a high pressure mercury lamp having a not very high mercury vapor pressure of about 1 MPa. This is because the fact that the lamp can be operated stably even if the operating pressure is very high means that the reliability of the lamp is high. That is to say, if the structure of this embodiment is applied to a lamp having a not very high operating pressure (the operating pressure of the lamp is less than about 30 MPa, for example, about 20 MPa to about 1 MPa), the reliability of the lamp that operates at that operating pressure can be improved. The structure of this embodiment can be obtained simply by introducing, into the sealing portion 2, the member of the second glass portion 7 as a new member, so that a small improvement can provide an effect of improving the withstand pressure. Therefore, this is very suitable for industrial applications. Moreover, in this embodiment, in consideration of the mechanism of the compositional deformation of the second glass portion 7, $HgBr_2$ which is halogen precursor is employed as a means for preventing the compositional deformation thereof. This also ensures the effect of improving the withstand pressure only by a small improvement, so that this is very suitable for industrial applications.

Next, a method for producing the lamp 100 of this embodiment will be described with reference to FIG. 7.

First, a glass pipe 80 for a discharge lamp including a luminous bulb portion 1' that will be formed into the luminous bulb (1) of the lamp 100 and side tube portions 2' extending from the luminous bulb portion 1' is prepared. The glass pipe 80 of this embodiment is obtained by heating a predetermined position of a cylindrical quartz glass having an outer diameter of 6 mm and an inner diameter of 2 mm for expansion to form the substantially spherical luminous bulb portion 1'. A glass tube 70 that will be formed into the second glass portion 7 is prepared separately. The glass tube 70 of this embodiment is a Vycor glass tube having an outer diameter of 1.9 mm, an inner diameter of 1.7 mm and a length (the longitudinal dimension) of 7 mm. The outer diameter of the glass tube 70 is smaller than the inner diameter of one of the side tube portions 2' of the glass pipe 80 so that the glass tube 70 can be inserted into the side tube portion 2'.

Figure 7:
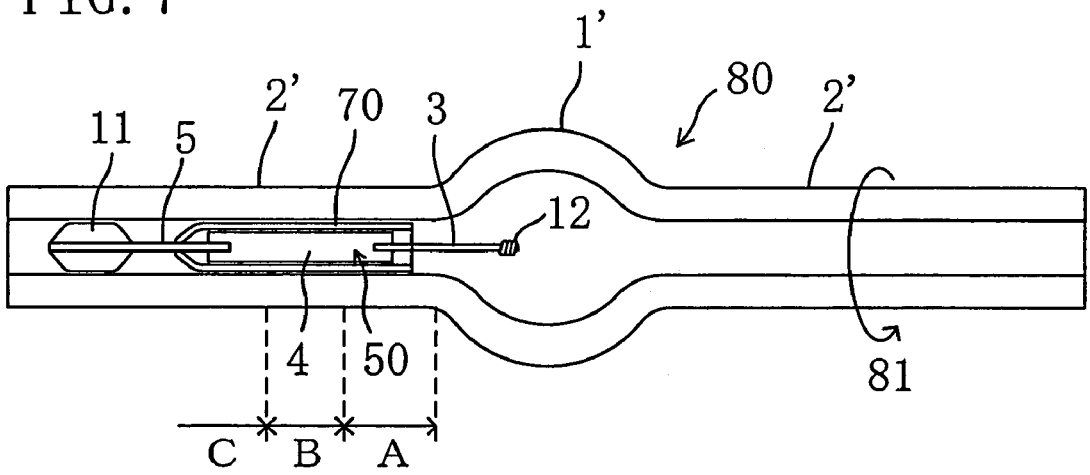
FIG. 7 is a cross-sectional view for explaining a process step of a method for producing the lamp 100 of the embodiment of the present invention.

The long glass tube (a long Vycor glass tube) 70 shown in FIG. 7 is formed to make one end thereof (that is, the end of the glass tube 70 opposite to the luminous bulb 1') small in inside diameter, and the glass tube 70 is fixed at one said end. The glass tube 70 may be fixed either so that the small diameter portion of the glass tube 70 supports the external lead 5, or so that with the pipe 80 set substantially perpendicular, the small diameter portion of the glass tube 70 is hung on corners of the metal foil (molybdenum foil) 4.

Next, the glass tube 70 is fixed to the side tube portion 2' of the glass pipe 80, and then a separately produced electrode structure 50 is inserted into the side tube portion 2' to which the glass tube 70 has been fixed. Subsequently, both ends of the glass pipe 80 with the electrode structure 50 inserted therein are attached to a rotatable chuck (not shown) while the airtightness in the glass pipe 80 is maintained. The chuck is connected to a vacuum system (not shown) and can reduce the pressure inside the glass pipe 80. After the glass pipe 80 is evacuated to a vacuum, a rare gas (Ar) with about 200 torr (about 20 kPa) is introduced. Thereafter, the glass pipe 80 is rotated around the electrode rod 3 as the central axis for rotation in the direction shown by arrow 81.

The electrode structure 50 includes the electrode rod 3, the metal foil 4 connected to the electrode rod 3 and the external lead 5 connected to the metal foil 4. The electrode rod 3 is a tungsten electrode rod, and the tungsten coil 12 is wound around the head thereof. A supporting member (metal hook) 11 for fixing the electrode structure 50 onto the inner surface of the side tube portion 2' is provided in one end of the external lead 5. The supporting member 11 shown in FIG. 4 is a molybdenum tape (Mo tape) made of molybdenum, but this can be replaced by a ring-shaped spring made of molybdenum.

Then, the side tube portion 2' and the glass tube 70 are heated and contracted (shrunk) so that the electrode structure 50 is sealed. In this sealing, portions A and C shown in FIG. 7 are heated and contracted, but a portion B is not heated and contracted. That is to say, this sealing is conducted discontinuously. Thus, the cavity 30 can be formed in the portion B. A rare gas is enclosed in the side tube portion 2' in this sealing, so that the cavity 30 with the rare gas enclosed therein can be formed.

In the formation step of the sealing portion 2, heating is performed with, for example, a burner (or a $CO_2$ laser) sequentially from the boundary portion between the luminous bulb portion 1' and the side tube portion 2' to the external lead 5. Heating for shrinking can be performed in the direction from the external lead 5 to the luminous bulb portion 1'.

After one of the sealing portions 2 is formed, a predetermined amount of mercury 6 (for example, about 200 mg/cc, about 300 mg/cc, or more than 300 mg/cc) is introduced from the end portion of the side tube portion 2' that is open. In this introduction, halogen precursor (for example, solid $HgBr_2$) is also introduced. Which of the mercury 6 and the halogen precursor is introduced first is insignificant, so that they may be introduced at the same time or either of them may be introduced first.

After the mercury 6 and the halogen precursor are introduced, the same process is performed on the other side tube portion 2'. Specifically, the electrode structure 50 is inserted into the side tube portion 2' that has not been sealed yet, and then the glass pipe 80 is evacuated to a vacuum (preferably to about $10^{-4}$ Pa), a rare gas is enclosed and heating is performed for sealing. It is preferable to perform heating for sealing while cooling the luminous bulb portion 1' in order to prevent mercury from evaporating. When both the side tube portions 2' are sealed in this manner, the lamp having the cavity 30 as well as the second glass portion 7 in the sealing portion 2 is completed.

Next, the mechanism that applies a compressive stress to the second glass portion 7 (or the vicinity of the circumference thereof) by the sealing portion formation process will be described with reference to FIGS. 14A and 14B. This mechanism is inferred by the inventors, and therefore the true mechanism may not be like this. However, for example, as shown in FIG. 3A, it is the fact that a compressive stress (compressive strain) is present in the second glass portion 7 (or the vicinity of the circumference thereof), and also it is the fact that the withstand pressure is improved by the sealing portion 2 including a portion to which the compressive stress is applied.

Figure 14A:
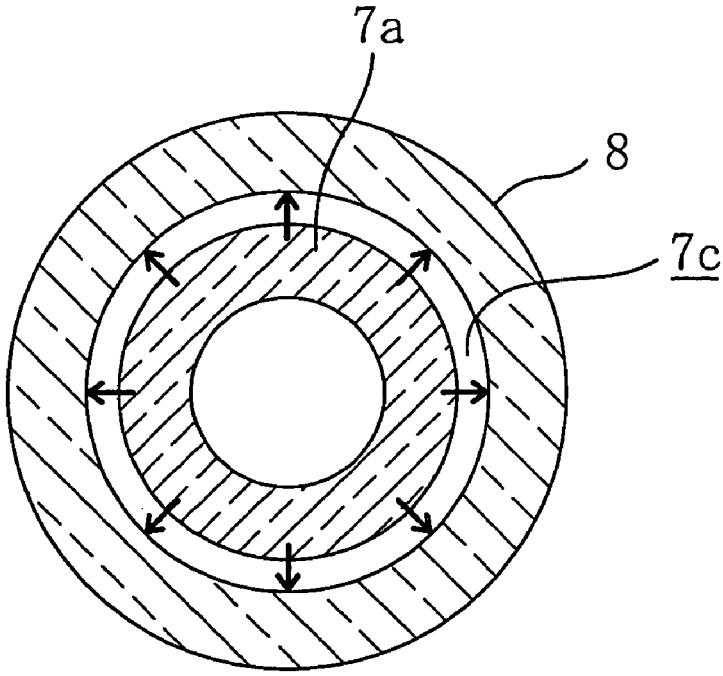
FIGS. 14A and 14B are cross-sectional views for explaining the mechanism that creates compressive strain in the second glass portion.
Figure 14B:
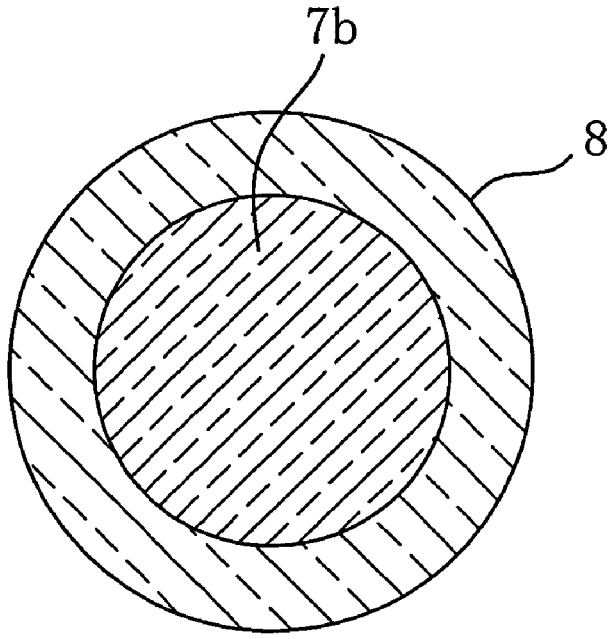

FIG. 14A is a schematic view showing the cross sectional structure at the time when the second glass portion 7*a* that is in the state of the glass tube 70 is inserted into the first glass portion 8 that is in the state of the side tube portion 2'. On the other hand, FIG. 14B is a schematic view showing the cross sectional structure at the time when the second glass portion 7*a* is softened into a molten state 7*b* in the structure of FIG. 14A. In this embodiment, the first glass portion 8 is made of quartz glass containing 99 wt % or more of $SiO_2$, and the second glass portion 7*a* is made of Vycor glass.

First, it is assumed that when a compressive stress (compressive strain) is present, there is a difference in the thermal expansion coefficient between materials that are in contact with each other in many cases. In other words, the reason why a compressive stress is applied to the second glass portion 7 that is provided in the sealing portion 2 is that in general there is a difference in the thermal expansion coefficient between the two components. However, in this case, in reality, there is no large difference in the thermal expansion coefficient between the two components, and they are substantially equal. More specifically, the thermal expansion coefficients of tungsten and molybdenum, which are metals, are about $46\times10^{-7}$/° C. and about 37 to $53\times10^{-7}$/° C., respectively. The thermal expansion coefficient of quartz glass constituting the first glass portion 8 is about $5.5\times10^{-7}$/° C., and the thermal expansion coefficient of Vycor glass is about $7\times10^{-7}$/° C., which is the same level as that of quartz glass. It does not seem possible that such a small difference in the thermal expansion coefficient causes a compressive stress of about 10 kgf/cm$^2$ or more between them. The characteristic difference between the two components lies in the softening point or the strain point rather than the thermal expansion coefficient. When this aspect is focused on, the following mechanism may explain why a compressive stress is applied. The softening point and the strain point of quartz glass are 1650° C. and 1070° C., respectively (annealing point is 1150° C.). The softening point and the strain point of Vycor glass are 1530° C. and 890° C., respectively (annealing point is 1020° C.).

When the first glass portion 8 (side tube portion 2') that is in the state shown in FIG. 14A is shrunk from the outside by heating, a gap 7*c* initially left between the two components is filled in so that the two components are in tight contact with each other. After shrinking, as shown in FIG. 14B, there is a point of time when the second glass portion 7*b* that is positioned in an inner portion than the first glass portion 8 and has a lower softening point is still softened (in the molten state) even though at that time the first glass portion 8 having a higher softening point and a larger area in contact with the air is relieved from the softened state (that is the point of time when it is solidified). The second glass portion 7*b* in this point of time has more flowability than the first glass portion 8, so that even if the thermal expansion coefficients of the two components are substantially the same in the regular state (at the time when they are not softened), it can be considered that the properties (e.g., elastic modulus, viscosity, density or the like) of the two components at this point of time are significantly different. Then, time passes further, and the second glass portion 7*b* that had flowability is cooled. Thus, when the temperature of the second glass portion 7*b* becomes lower than the softening point, the second glass portion 7 is also solidified like the first glass portion 8. If the first glass portion 8 and the second glass portion 7 have the same softening point, the two glass portions may be cooled gradually from the outside and solidified without letting a compressive strain remain. However, in the structure of this embodiment, the outer glass portion (8) is solidified earlier and then in some time later, the inner glass portion (7) is solidified. As a result, a compressive strain remains in the second glass portion 7 that is in the inner position. Considering these points, it can be said that the state of the second glass portion 7 is obtained as a result of performing a kind of indirect pinching.

If such a compressive strain remains, in general, the difference in the thermal expansion coefficient between the two components (7 and 8) will terminate the attachment state of the two components at a certain temperature. However, in this embodiment, since the thermal expansion coefficients of the two components are substantially equal, it can be inferred that the attachment state of the two components (7 and 8) can be maintained even if a compressive strain is present.

Furthermore, it was found that in order to apply a compressive stress of about 10 kgf/cm$^2$ or more to the second glass portion 7, it is necessary to heat the lamp constructed by the above-described production method (a half-finished lamp assembly) at a higher temperature than the strain point of the second glass portion 7. In addition, it was also found that it is preferable to heat the lamp at 1030° C. for two hours or more. More specifically, the half-finished lamp 100 can be placed in a furnace with 1030° C. and annealed (i.e., baked in a vacuum or baked at a reduced pressure). The temperature of 1030° C. is only an example and any temperature that is higher than the strain point temperature of the second glass portion (Vycor glass) 7 can be used. That is to say, the heating temperature can be higher than the strain point temperature of Vycor of 890° C. A preferable range of temperatures is that larger than the strain point temperature of Vycor of 890° C. and lower than the strain point temperature of the first glass portion (quartz glass) (strain point temperature of $SiO_2$ is 1070° C.), but some effect were seen at about 1080° C. or 1200° C. in the experiments conducted by the inventors in some cases.

For comparison, when a high pressure discharge lamp that had not been annealed was measured by the sensitive color plate method, a compressive stress of about 10 kgf/cm$^2$ or more was not observed, although the second glass portion 7 was provided in the sealing portion of the high pressure discharge lamp.

As long as it is at least two hours, there is no limitation regarding the upper limit of annealing (or vacuum baking) except for the upper limit that might be useful in view of economy. Any preferable time can be set as appropriate in the range of two hours or more. If some effect can be seen with a heat treatment for less than two hours, a heat treatment (annealing) can be performed for less than two hours. This annealing process may achieve high purity of the lamp, in other words, reduction of the impurities. This is because it seems that annealing the lamp assembly can remove the water content that is considered to adversely affect the lamp (e.g., the water content of Vycor). If annealing is performed for 100 hours or more, the water content of the Vycor can be removed substantially completely from the lamp.

In the above description, an example in which the second glass portion 7 is formed of Vycor glass has been described. However, even if the second glass portion 7 is formed of glass containing 62 wt % of $SiO_2$, 13.8 wt % of $Al_2O_3$, 23.7 wt % of CuO (product name: SCY2 manufactured by SEMCOM Corporation: Strain point of 520° C.), the state in which a compressive stress is applied at least in the longitudinal direction thereof is found to be achieved.

Next, the mechanism, which is inferred by the inventors, by which a compressive stress is applied to the second glass portion 7 of the lamp when annealing is performed on the half-finished lamp assembly at a predetermined temperature for a predetermined period of time or longer will be described with reference to FIG. 15.

Figure 15A:
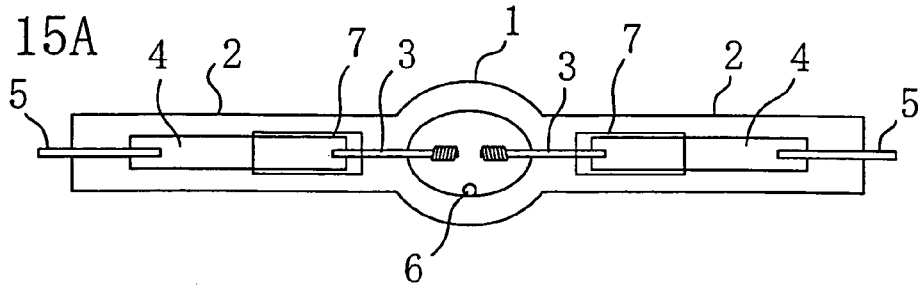
FIGS. 15A to 15D are schematic cross-sectional views for illustrating the mechanism by which compressive stress is applied by annealing.

First, as shown in FIG. 15A, a half-finished lamp assembly is prepared. The lamp assembly is produced in the manner as described above.

Figure 15B:
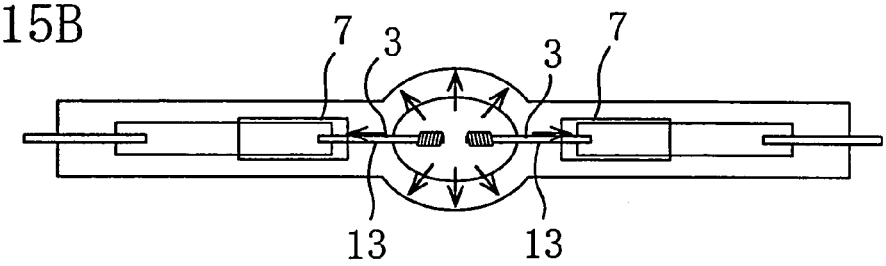

Next, when the lamp assembly is heated, as shown in FIG. 15B, mercury (Hg) 6 starts to evaporate, and as a result, a pressure is applied to the luminous bulb 1 and the second glass portion 7. The arrow in FIG. 15B indicates pressure (e.g., 100 atm or more) caused by the vapor of the mercury 6. The vapor pressure of the mercury 6 is applied not only to the inside of the luminous bulb 1 but also to the second glass portion 7, because there are gaps 13 that cannot recognized by human eyes in the sealed portion of the electrode rods 3.

The temperature for heating is further increased and heating continues at a temperature of more than the strain point of the second glass portion 7 (e.g., 1030° C.). Then, the vapor pressure of mercury is applied to the second glass portion 7 in the state where the second glass portion 7 is soft, so that a compressive stress is generated in the second glass portion 7. It is estimated that a compressive stress is generated in about four hours, for example, when heating is performed at the strain point, and in about 15 minutes when heating is performed at an annealing point. These times are derived from the definitions of the strain point and the annealing point. More specifically, the strain point refers to a temperature at which internal strain is substantially removed after four hour storage at that temperature. The annealing point refers to a temperature at which internal strain is substantially removed after 15 minute storage at that temperature. The above estimated periods of time are derived from these facts.

Figure 15C:
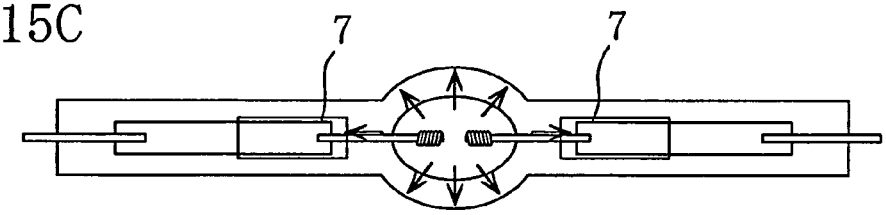
Figure 18A:
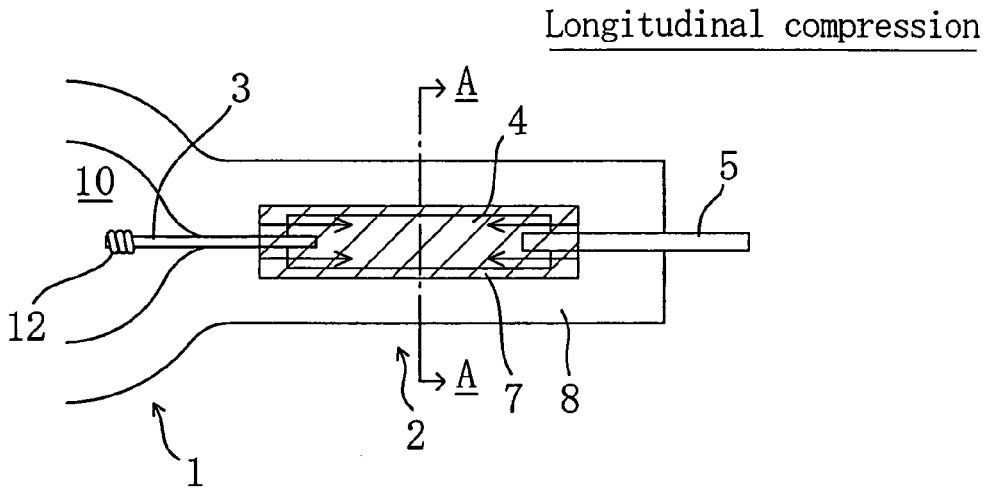
FIG. 18A is a schematic view showing a compressive stress in the longitudinal direction present in the second glass portion.
Figure 18B:
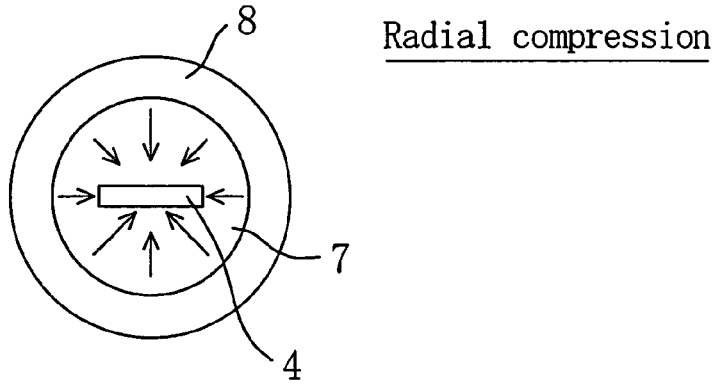
FIG. 18B is a cross-sectional view taken along the line A—A of FIG. 18A.

Next, heating is stopped, and the lamp assembly is cooled. Even after heating is stopped, as shown in FIG. 15C, the mercury continues to evaporate. Therefore, the temperature of the second glass portion 7 is decreased to a temperature lower than the strain point with the portion 7 under the pressure by the mercury vapor. Consequently, as shown in FIG. 18, not only a compressive stress in the longitudinal direction but also a compressive stress in the radial or other direction of the metal foil 4 remain in the second glass portion 7 (however, only the longitudinal compressive stress can be observed with the strain detector.)

Figure 15D:
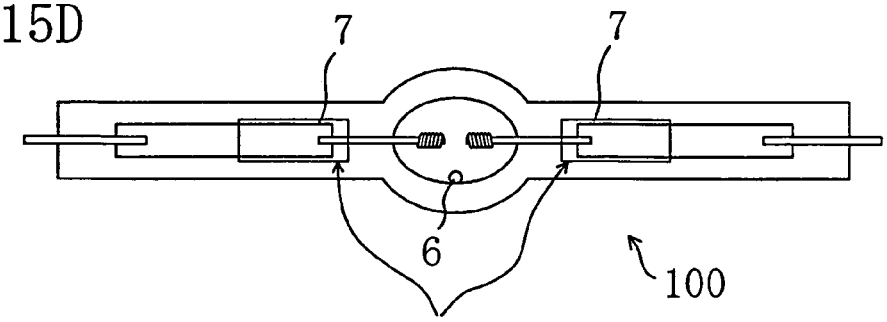

Finally, when cooling proceeds up to about room temperature, as shown in FIG. 15D, a lamp 100 in which a compressive stress of about 10 kgf/cm$^2$ or more is present in the second glass portion 7 can be obtained. As shown in FIGS. 15B and 15C, the vapor pressure of the mercury applies pressure to both the second glass portions 7, so that this approach can apply a compressive stress of about 10 kgf/cm$^2$ or more to both the sealing portions 2 reliably.

Figure 16:
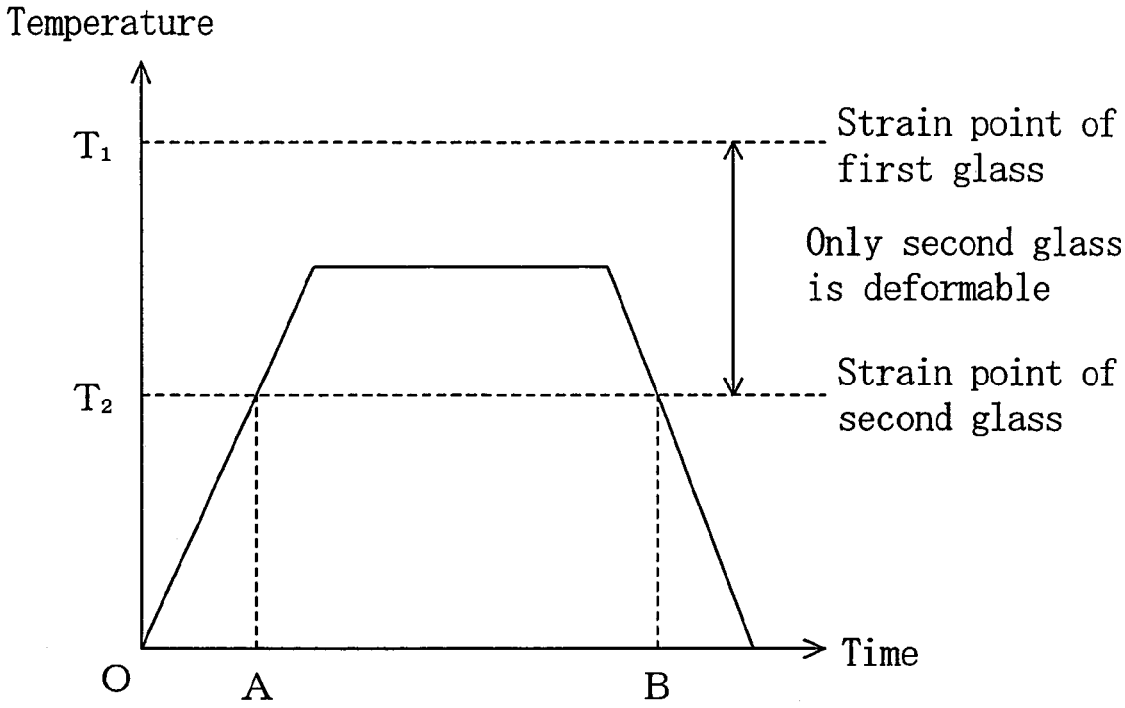
FIG. 16 is a graph schematically showing a profile of a heating process (annealing process).
Figure 17:
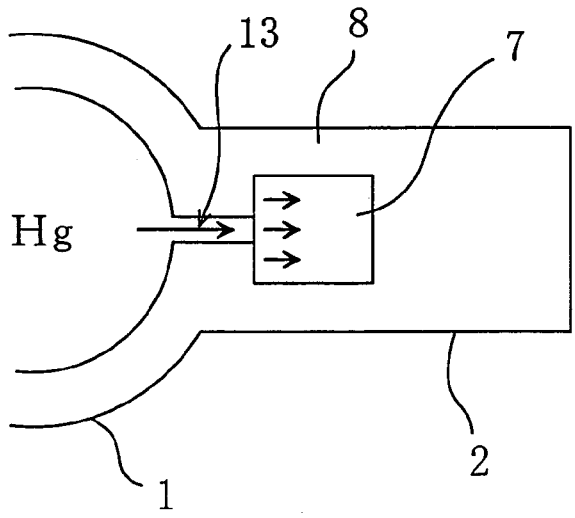
FIG. 17 is a schematic view for illustrating the mechanism by which compressive stress is generated in the second glass portion by mercury vapor.

FIG. 16 schematically shows the profile of this heating. First, heating is started (time O), and then the lamp temperature reaches the strain point ($T_2$) of the second glass portion 7 (time A). Then, the lamp is stored at a temperature between the strain point ($T_2$) of the second glass portion 7 and the strain point ($T_1$) of the first glass portion 8 for a predetermined period of time. This temperature range can basically be regarded as a range in which only the second glass portion 7 can be deformed. During this storage, as shown in the schematic view of FIG. 17, a compressive stress is generated in the second glass portion 7 by the mercury vapor pressure (e.g., 100 atm or more).

It seems that applying pressure to the second glass portion 7 by the mercury vapor pressure is the most effective approach to utilize the annealing treatment, but it can be inferred that if some force can be applied to the second glass portion 7, not only the mercury vapor pressure but also this force (e.g., pushing the external lead 5) can apply a compressive stress to the second glass portion 7 as long as the lamp is stored at a temperature range between $T_2$ and $T_1$ shown in FIG. 16.

Then, when heating is stopped, the lamp is cooled and the temperature of the second glass portion 7 becomes lower than the strain point ($T_2$) after time B. When the temperature becomes lower than the strain point ($T_2$), the compressive stress of the second glass portion 7 remains. In this embodiment, after the lamp is stored at 1030° C. for 150 hours, it is cooled (natural cooling). Thus, the compressive stress of the second glass portion 7 is applied and let to remain.

By the above-described mechanism, a compressive stress is generated by the mercury vapor pressure, so that the magnitude of the compressive stress depends on the mercury vapor pressure (in other words, the amount of mercury enclosed).

In general, lamps tend to be broken as the mercury amount is increased. However, if the sealing structure of this embodiment is used, the compressive stress is increased as the mercury amount is increased and the withstand pressure is improved. That is to say, with the structure of this embodiment, a higher withstand pressure structure can be realized as the mercury amount is increased. Therefore, stable operation at very high withstand pressure that cannot be realized by current techniques can be realized.

In this embodiment, the sealing portion 2 is formed with the cavity 30, thereby preventing creation of the point transitioning from compressive strain to tensile strain (for example, 7*c* in FIG. 3) during annealing. This prevents tearing or creases of the metal foil 4 during or immediately after annealing or at the initial operation of the lamp. Moreover, this also prevents thinning of a predetermined portion of the metal foil 4 (for example, a central portion thereof) which causes an increase in the resistance of that portion.

That is to say, with the method for producing a high pressure discharge lamp according to this embodiment, the forward portion (17*a* in FIG. 4 and the portion A in FIG. 7) and the backward portion (17*c* in FIG. 4 and the portion C in FIG. 7) of the glass tube 70 are tightly attached to the side tube portion 2', so that the cavity 30 can be formed easily between the central portion (17*b* in FIG. 4 and the portion B in FIG. 7) and the side tube portion 2'. Therefore, the cavity 30 can prevent tearing or other problems of the metal foil 4. Moreover, with the producing method according to this embodiment, a rare gas can be introduced easily within the cavity 30, so that a high pressure discharge lamp having a high withstand pressure and a low starting voltage can be produced.

Second Embodiment

Figure 8:
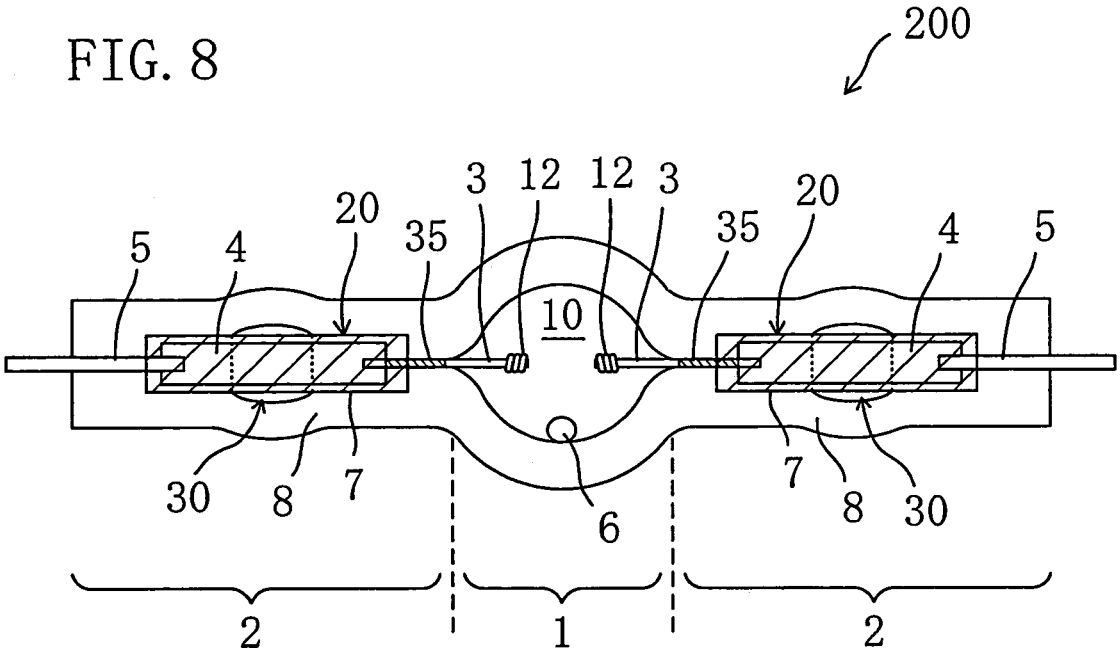
FIG. 8 is a schematic cross-sectional view showing the structure of a high pressure discharge lamp 200 of an embodiment of the present invention.

A high pressure discharge lamp according to a second embodiment of the present invention will be described with reference to FIG. 8. FIG. 8 is a schematic cross-sectional view showing the structure of a high pressure discharge lamp 200 of this embodiment. Like the high pressure discharge lamp 100 of the first embodiment, the cavity 30 is enclosed in the sealing portion 2 of the lamp 200.

In order to further improve the strength against pressure of the lamp 100 of the first embodiment, it is preferable to form a metal film (e.g., a Pt film) 35 on a surface of at least a portion of the electrode rod 3 that is buried in the sealing portion 2 like the lamp 200 shown in FIG. 8. It is sufficient that the metal film 35 is formed of at least one metal selected from the group consisting of Pt, Ir, Rh, Ru, and Re. The metal film 35 may be formed in a single layer made of a Pt layer, or the metal film 35 may be formed, in view of adhesion, in such a manner that the lower layer is an Au layer and the upper layer is, for example, a Pt layer.

In the lamp 200, the metal film 35 is formed on the surface of the portion of the electrode rod 3 that is buried in the sealing portion 2, and therefore small cracks are prevented from being generated in the glass positioned around the electrode rod 3. That is to say, in the lamp 200, in addition to the effects obtained by the lamp 100, the effect of preventing cracks can be obtained, and thus the strength against pressure can be improved further. The effect of preventing cracks will be described further below.

In the case of a lamp without the metal film 35 in the electrode rod 3 positioned in the sealing portion 2, in forming the sealing portion in a lamp production process, the glass of the sealing portion 2 and the electrode rod 3 are attached once, and then during cooling, the two components are detached because of the difference in the thermal expansion coefficient between the two components. In this case, cracks are generated in the quartz glass around the electrode rod 3. The presence of these cracks makes the strength against pressure lower than that of an ideal lamp without cracks.

In the case of the lamp 200 shown in FIG. 8, the metal film 35 having a Pt layer on its surface is formed on the surface of the electrode rod 3, so that the wettability between the quartz glass of the sealing portion 2 and the surface (Pt layer) of the electrode rod 3 becomes poor. In other words, the wettability of a combination of platinum and quartz glass is poorer than that of a combination of tungsten and quartz glass, so that the two components are not attached and easily detached. As a result, the poor wettability between the electrode rod 3 and the quartz glass makes it easy to detach two components during cooling subsequent to the heating, which prevents small cracks from being generated. The lamp 200 produced based on the technical idea that generation of cracks are prevented by utilizing poor wettability as described above exhibits higher strength against pressure than the lamp 100.

Figure 9:
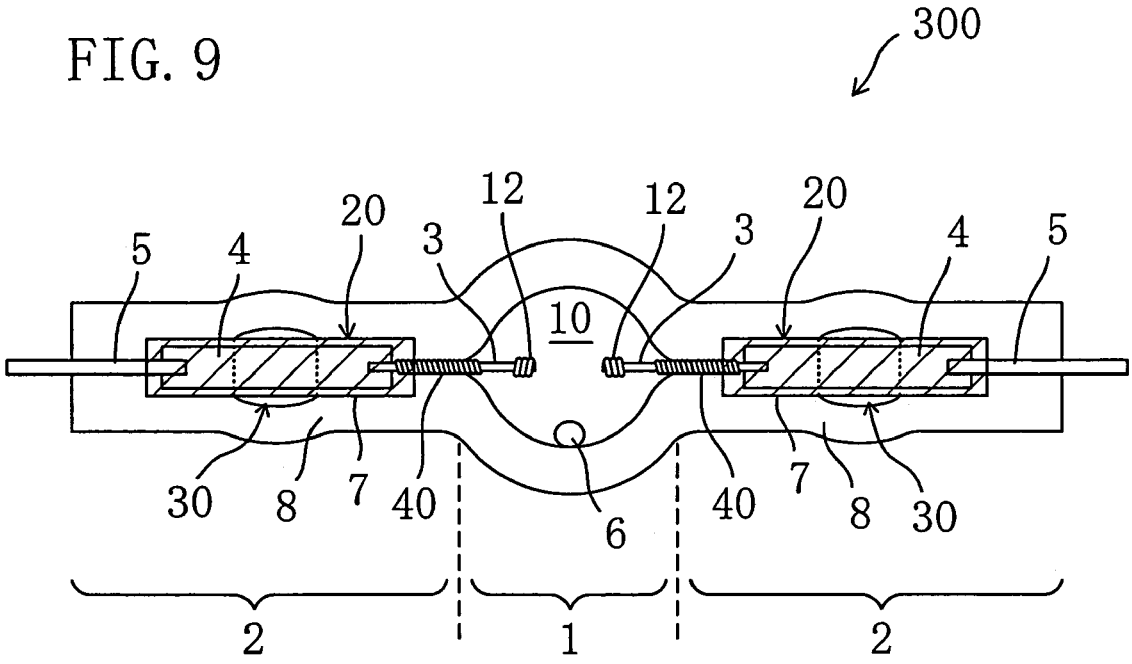
FIG. 9 is a schematic cross-sectional view showing the structure of a high pressure discharge lamp 300 of an embodiment of the present invention.

The structure of the lamp 200 shown in FIG. 8 can be replaced by the structure of a lamp 300 shown in FIG. 9. In the lamp 300, a coil 40 whose surface is coated with the metal film 35 is wound around the surface of the portion of the electrode rod 3 that is buried in the sealing portion 2 in the structure of the lamp 100 shown in FIG. 4. In other words, the lamp 300 has a structure in which the coil 40 having at least one metal selected from the group consisting of Pt, Ir, Rh, Ru, and Re at least on its surface is wound around the base of the electrode rod 3. In the structure shown in FIG. 9, the coil 40 is wound up to the portion of the electrode rod 3 that is positioned in the discharge space 10 of the luminous bulb 1. Also in the structure of the lamp 300 shown in FIG. 9, the wettability between the electrode rod 3 and the quartz glass can be made poor by the metal film 35 on the surface of the coil 40, so that small cracks can be prevented from being generated.

The metal on the surface of the coil 40 can be formed, for example, by plating. Like the structure of the lamp shown in FIG. 8, the metal film 35 may be formed in a single layer made of a Pt layer, or the metal film 35 may be formed, in view of adhesion, in such a manner that the lower layer is an Au layer and the upper layer is, for example, a Pt layer. It is preferable in view of attachment that an Au layer for the lower layer is first formed on the coil 40 and then, for example, a Pt layer for the upper layer is formed. However, even the coil 40 plated only with Pt without having the two layered structure of Pt (upper layer)/Au (lower layer) plating can provide practically sufficient attachment.

In the case of the structure in which at least one metal (referred to also as "Pt or the like") selected from the group consisting of Pt, Ir, Rh, Ru, and Re is provided on the surface of the electrode rod 3 or the surface of the coil 40, the significance of the second glass portion 7 being present around the metal foil 4 as in the structure of the embodiment of the present invention is very large. Further description of this point follows. A metal such as Pt can be evaporated to some extent by heating during processing in a lamp production process (sealing process). Therefore, if the evaporated metal is diffused to the metal foil 4, the attachment between the metal foil and the glass is weakened, which may degrade the withstand pressure. However, as in the structure of this embodiment, when the second glass portion 7 is provided around the metal foil 4 and a compressive strain is present there, then the poor wettability between Pt or the like and the glass is no more relevant. Consequently, degradation of withstand pressure caused by the diffusion of Pt or the like can be prevented.

It is to be noted that in the structures shown in FIGS. 8 and 9, a material in solid form (at ambient temperature) such as $HgBr_2$, not a material in gaseous form such as $CH_2Br_2$, is preferably used as the form of halogen to be enclosed (specifically halogen precursor). This is because a metal such as Pt may be etched by halogen in gaseous form as in the case of Vycor glass that deteriorates by the reaction with halogen in gaseous form when it is sealed.

Furthermore, the lamps 100, 200 and 300 according to the embodiments of the present invention can be formed into a lamp with a mirror or a lamp unit in combination with a reflecting mirror.

Figure 10:
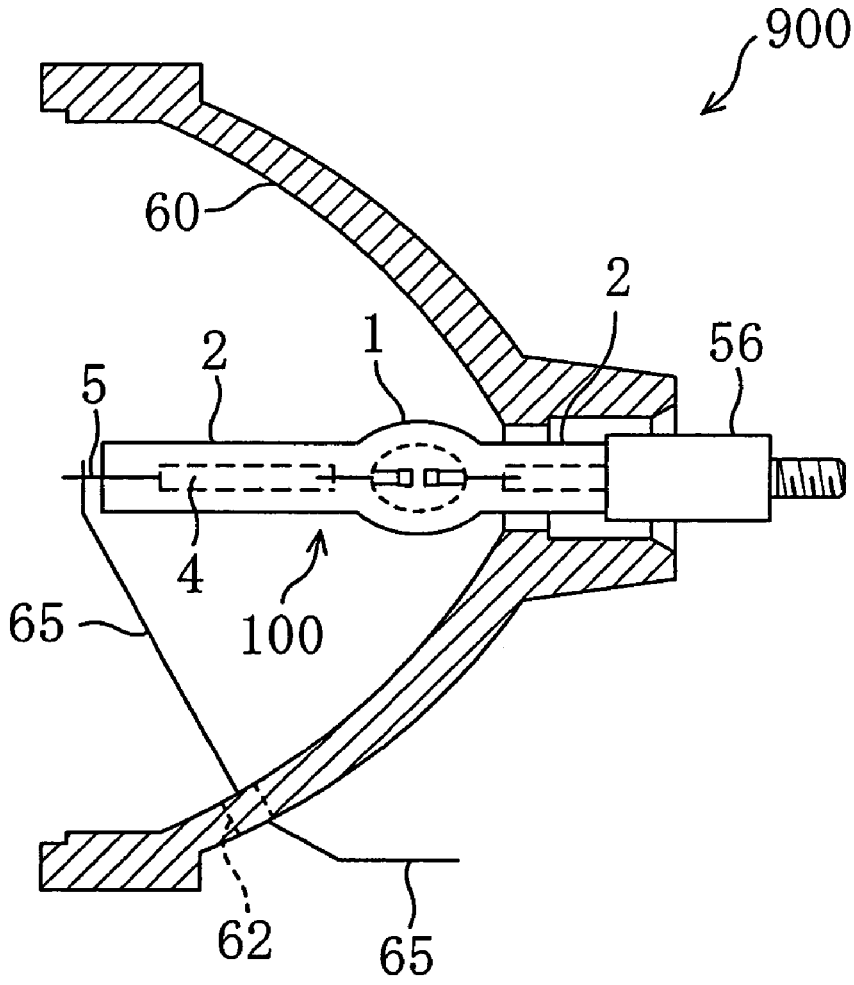
FIG. 10 is a schematic cross-sectional view showing the structure of a lamp 900 with a mirror.
Figure 11:
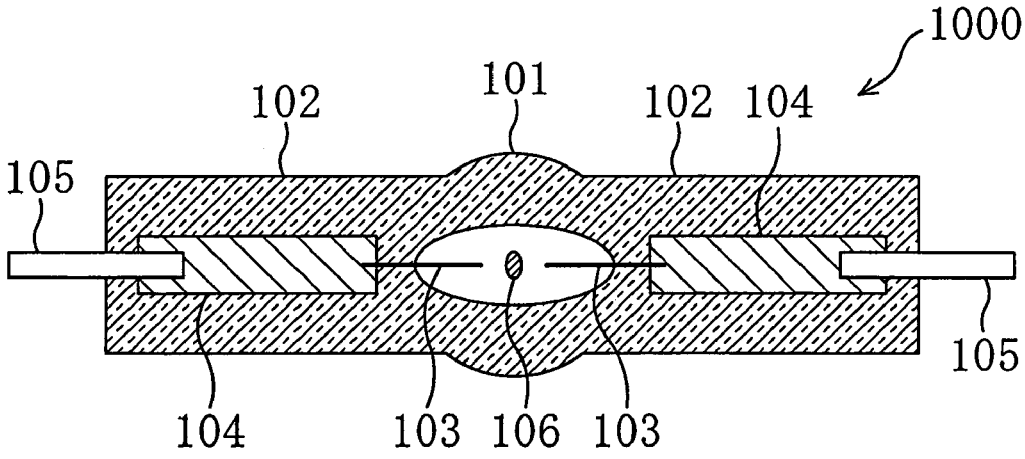
FIG. 11 PRIOR ART
FIG. 11 is a schematic cross-sectional view showing the structure of a conventional high pressure mercury lamp.

FIG. 10 is a schematic cross-sectional view showing a lamp 900 with a mirror including the lamp 100 of this embodiment.

The lamp 900 with a mirror includes a lamp 100 having a substantially spherical luminous bulb 1 and a pair of sealing portions 2, and a reflecting mirror 60 for reflecting light emitted from the lamp 100. The lamp 100 is only an example, and the lamp 200 or the lamp 300 can be used as well. The lamp 900 with a mirror may further include a lamp housing for holding the reflecting mirror 60. The lamp with a mirror including a lamp housing is encompassed in a lamp unit.

The reflecting mirror 60 is configured to reflect radiated light from the lamp 100 such that the light becomes, for example, a parallel light flux, a condensed light flux converging a predetermined small region, or a divergent light flux equivalent to a light diverged from a predetermined small region. As the reflecting mirror 60, for example, a parabolic mirror or an ellipsoidal mirror can be used.

In this embodiment, a lamp base 56 is provided in one of the sealing portions 2 of the lamp 100, and the lamp base 56 and an external lead (5) extending from the sealing portion 2 are electrically connected to each other. The sealing portion 2 and the reflecting mirror 60 are attached tightly with, for example, an inorganic adherent (e.g., cement) so that they are integrated into one unit. An extending lead wire 65 is electrically connected to the external lead 5 of the sealing portion 2 positioned on the front opening side of the reflecting mirror 60, and the extending lead wire 65 is extended from the lead wire 5 to the outside of the reflecting mirror 60 through an opening 62 of the reflecting mirror 60 for drawing the lead wire. For example, a front glass can be attached in the front opening of the reflecting mirror 60.

Such a lamp with a mirror or a lamp unit can be attached to an image projecting apparatus such as a projector employing liquid crystal or DMD (Digital Micromirror Device), and can be used as a light source of an image projecting apparatus. Furthermore, an image projecting apparatus can be formed by combining such a lamp with a mirror or a lamp unit with an optical system including an image device (DMD panels or liquid crystal panels). For example, projectors (digital light processing (DLP) projectors) using DMDs or liquid crystal projectors (including reflective projectors using a LCOS (Liquid Crystal on Silicon) structure) can be provided. Furthermore, the lamp, the lamp with a mirror or the lamp unit of this embodiment can be used preferably not only as a light source of an image projecting apparatus but also for other applications such as a light source for an ultraviolet ray stepper, a light source for a sport stadium, a light source for an automobile headlight, and a floodlight for illuminating a traffic sign.

Other Embodiments

In the above embodiments, a mercury lamp using mercury as a luminous material has been described as one example of a high pressure discharge lamp, but the present invention can be applied to any high pressure discharge lamps having the structure in which the sealing portions (seal portions) maintain the airtightness of the luminous bulb. For example, the present invention can be applied to a high pressure discharge lamp such as a metal halide lamp enclosing a metal halide or a xenon lamp. This is because also in metal halide lamps or the like, it is preferable that the increased withstand pressure is better. That is to say, a high reliable lamp having a long life can be realized by preventing leakage or cracks. Moreover, if the structure of this embodiment is applied to a metal halide lamp enclosing not only mercury but also a metal halide, the following effect can be obtained. The attachment of the metal foil 4 in the sealing portion 2 can be improved by providing the second glass portion 7, so that the reaction between the metal foil 4 and a metal halide (or halogen or an alkali metal) can be suppressed. Therefore, the reliability of the structure of the sealing portion can be improved. In particular, in the case where the second glass portion 7 is positioned in a portion of the metal rod 3 like the structure shown in FIGS. 4, 8 and 9, the second glass portion 7 can effectively reduce metal halide penetration which occurs from a small gap between the metal rod 3 and the glass of the sealing portion 2 and which causes embrittlement of the metal foil 4 due to the reaction of the foil with the metal halide. Thus, the structure of the above embodiment can be applied preferably to a metal halide lamp.

In recent years, a mercury-free metal halide lamp with no mercury enclosed has been under development, and the techniques of the above embodiments can be applied to a mercury-free metal halide lamp. This will be described in greater detail below.

An example of the mercury-free metal halide lamp to which the present invention is applied is a lamp having the structure shown in FIGS. 4, 8 and 9, but not substantially enclosing mercury and enclosing at least a first halide, a second halide and rare gas. The metal constituting the first halide is a luminous material. The second halide has a vapor pressure higher than that of the first halide and is a halide of one or more metals that emit light in a visible light region with more difficulty than the metal constituting the first halide. For example, the first halide is a halide of one or more metals selected from the group consisting of sodium, scandium, and rare earth metals. The second halide has a relatively larger vapor pressure and is a halide of one or more metals that emit light in a visible light region with more difficulty than the metal constituting the first halide. More specifically, the second halide is a halide of at least one metal selected from the group consisting of Mg (magnesium), Fe (iron), Co (cobalt), Cr (chromium), Zn (zinc), Ni (nickel), Mn (manganese), Al (aluminum), Sb (antimony), Be (beryllium), Re (rhenium), Ga (gallium), Ti (titanium), Zr (zirconium), and Hf (hafnium). The second halide containing at least Zn halide is more preferable.

Another combination example is as follows. In a mercury-free metal halide lamp including a translucent luminous bulb (airtight vessel) 1, a pair of electrodes 3 provided in the luminous bulb 1, and a pair of sealing portions 2 coupled to the luminous bulb 1, $ScI_3$ (scandium iodide) and NaI (sodium iodide) as luminous materials, $InI_3$ (indium iodide) and TlI (thallium iodide) as alternative materials to mercury, and rare gas (e.g., Xe gas at 1.4 MPa) as starting aid gas are enclosed in the luminous bulb 1. In this case, $ScI_3$ (scandium iodide) and NaI (sodium iodide) constitute the first halide, and $InI_3$ (indium iodide) and TlI (thallium iodide) constitutes the second halide. The second halide can be any halide as long as it has a comparatively high vapor pressure and can serve as an alternative to mercury. Therefore, for example, Zn iodide can be used instead of $InI_3$ (indium iodide).

The reason why the technique of the first embodiment can be applied preferably to such a mercury-free metal halide lamp will be described below.

First, the efficiency of a mercury-free metal halide lamp employing an alternative substance of Hg (for example, Zn halide) is lower than that of a lamp containing mercury. In order to increase the efficiency, it is very advantageous to increase the operating pressure for lamp operation. The lamp of the first embodiment has a structure that improves the withstand pressure, so that a rare gas can be enclosed to a high pressure. Therefore, the efficiency can be improved easily. Thus, a mercury-free metal halide lamp that can be put to practical use can be realized easily. In this case, Xe having a low thermal conductivity is preferable as the rare gas.

In the case of a mercury-free metal halide lamp, since mercury is not enclosed therein, it is necessary to enclose halogen in a larger amount than in the case of a metal halide lamp containing mercury. Therefore, the amount of halogen that reaches the metal foil 4 through a gap near the electrode rod 3 is increased, and the halogen reacts with the metal foil 4 (the base portion of the electrode rod 3 in some cases). As a result, the sealing portion structure becomes weak and leakage tends to occur. In the structures shown in FIGS. 8 and 9, the surface of the electrode rod 3 is coated with the metal film 35 (or the coil 40), so that the reaction between the electrode rod 3 and the halogen can be prevented effectively. As shown in FIG. 4, in the case of the structure in which the second glass portion 7 is positioned around the electrode rod 3, the second glass portion 7 can prevent the halide (e.g., Sc halide) from penetrating. Thus, it is possible to prevent leakage from occurring. Therefore, the mercury-free metal halide lamp having the above-described structure has a higher efficiency and a longer life than a conventional mercury-free metal halide lamp. This can be said widely for lamps for general illumination. For lamps for headlights of automobiles, the following advantage can be provided.

In the case of a headlight of an automobile, there is a demand that light of the headlight be fully provided at the moment when a switch of the headlight is turned on. In order to meet this demand, it is effective to enclose a rare gas (specifically, Xe) to a high pressure. However, if Xe is enclosed to a high pressure in a regular metal halide lamp, the possibility of breakage is high. This is not preferable as a lamp for a headlight for which higher safety is required. This is because the malfunction of a headlight at night leads to a car accident. The mercury-free metal halide lamp having the structure of the above embodiment has an improved withstand pressure, so that even if Xe is enclosed to a high pressure, the operation start properties can be improved with the safety ensured. In addition, it attains a long life, so that it is used more preferably for a headlight.

Furthermore, in the above embodiments, the case where the mercury vapor pressure of the lamp is about 20 MPa or 30 MPa or more (the case of a so-called ultrahigh pressure mercury lamp) has been described, but this does not eliminate the application of this embodiment to a high pressure mercury lamp having a mercury vapor pressure of about 1 MPa. The present invention can be applied to general high pressure discharge lamps including ultrahigh pressure mercury lamps and high pressure mercury lamps. It should be noted that the mercury vapor pressure of a lamp currently called an ultrahigh pressure mercury lamp is 15 MPa or more (the amount of mercury enclosed is 150 mg/cc or more).

The fact that stable operation can be achieved at a very high operating pressure means high reliability of the lamp. Therefore, when the structure of this embodiment is applied to a lamp having a not very high operating pressure (the operating pressure of the lamp is less than about 30 MPa, e.g., about 20 MPa to 1 MPa), the reliability of the lamp operating at that operating pressure can be improved.

A technical significance of a lamp that can realize a high strength against pressure will be further described below. In recent years, in order to obtain a high pressure mercury lamp of high output and high power, a short arc type mercury lamp having a short arc length (interelectrode distance) (e.g., the interelectrode distance is 2 mm or less) has been under development. In the case of the short arc type lamp, it is necessary to enclose a larger amount of mercury than usual in order to suppress a rapid evaporation of the electrode due to an increase of current. As described above, in the conventional structure, there was the upper limitation on the strength against pressure, so that there was also the upper limitation of the amount of mercury to be enclosed (e.g., about 200 mg/cc or less). Therefore, there was a limitation on the realization of the lamp exhibiting better characteristics. The lamp of this embodiment can eliminate such a conventionally existing limitation, and can promote the development of the lamp exhibiting excellent characteristics that could not be realized in the past. The lamp of this embodiment makes it possible to realize a lamp having an amount of mercury to be enclosed of more than about 200 mg/cc or about 300 mg/cc or more.

As described above, the technology that can realize an amount of mercury to be enclosed of about 300 to 400 mg/cc or more (operating pressure for lamp operation of 30 to 40 MPa) has a significance that the safety and reliability of lamps, especially lamps of a level exceeding the operating pressure for lamp operation of 20 MPa (that is, lamps having an operating pressure exceeding a currently-used pressure of 15 to 20 MPa, for example a lamp with an operating pressure of 23 MPa or more or 25 MPa or more) can be guaranteed. In the case of mass production of lamps, it is inevitable that there are variations in the characteristics of the lamps, so that it is necessary to ensure the withstand pressure with consideration for the margin even for a lamp having a light operating pressure of about 23 MPa. Therefore, the technology that can achieve a withstand pressure of 30 MPa or more also provides a large advantage to lamps having a withstand pressure of less than 30 MPa from the viewpoint that products can be actually supplied. If lamps that can operate at a withstand pressure of 23 MPa or even lower are produced using the technology that can achieve a withstand pressure of 30 MPa, the safety and the reliability thereof can be improved.

Therefore, the structure of this embodiment can also improve the lamp characteristics in terms of reliability. In the lamp of the above embodiment, the sealing portion 2 is produced by a shrinking technique, but it can be produced by a pinching technique. Also, a double-ended type high pressure discharge lamp has been described, but the technique of the above embodiment can be applied to a single-ended type discharge lamp. In the above embodiment, the second glass portion 7 is formed from the glass tube (70) made of, for example, Vycor, but it does not have to be formed from a glass tube. Not only a glass structure which covers all sides of the metal foil 4 but even a glass structure which is in contact with the metal foil 4 and which can let a compressive stress present in a portion of the sealing portion 2 can be contemplated as the second glass portion 7, and therefore the glass structure to be the second glass portion 7 does not have to be formed from a glass tube. For example, a glass structure that has a slit in a portion of the glass tube 70 and has a C shape can be used, and for example, carats (glass pieces or glass plates) made of Vycor can be disposed in contact with one side or both sides of the metal foil 4. Alternatively, for example, a glass fiber made of Vycor can be disposed to cover all sides of the metal foil 4. However, when a structure from glass powder such as a structure of sintered glass material formed by compressing and sintering glass powder, is used instead of the glass structure, a compressive stress cannot be present in a portion of the sealing portion 2. Therefore, it is better not to use a structure from glass powder.

In addition, the distance (arc length) between the pair of electrodes 3 can be a distance of a short arc type or can be longer than that. The lamp of the above embodiment can be used as either of an alternating current operation type and a direct current operation type. Furthermore, the structures shown in the above embodiment and the modified examples can be used mutually. The sealing portion structure including the metal foil 4 has been described, but it is possible to apply the structure of the above embodiment to a sealing portion structure without a foil. Also in the sealing portion structure without a foil, it is important to increase the withstand pressure and the reliability. More specifically, one electrode rod (tungsten rod) 3 with no molybdenum foil 4 is used as the electrode structure 50. The second glass portion 7 is disposed at least in a portion of that electrode rod 3, and the first glass portion 8 is formed to cover the second glass portion 7 and the electrode rod 3. Thus, a sealing portion structure can be constructed. In the case of this structure, the external lead 5 can be formed of the electrode rod 3.

In the above-described embodiment, discharge lamps have been described, but the technique of the first embodiment is not limited to the discharge lamps, and can be applied to any lamps other than discharge lamps (e.g., incandescent lamps) as long as they can retain the airtightness of the luminous bulb by the sealing portions (seal portions).

An exemplary incandescent lamp is a double-ended type incandescent lamp (e.g., a halogen incandescent lamp) having a structure shown in FIG. 4 in which portions of the electrode rods 3 in the luminous bulb 1 are used as inner leads (internal leading-in wires) and in which a filament is provided between the heads of the respective inner leads. An anchor can be provided in the luminous bulb 1. The techniques of the present invention can also be applied to a single-ended type incandescent lamp. For such a halogen incandescent lamp as well, breakage is a very important issue to be addressed, so that the technique of the above-described embodiment that prevents breakage has a large technical significance.

The preferable embodiments have been described above, but the description above is not limiting, and various modifications can be made.

What is claimed is:

1. A high pressure discharge lamp comprising:

a luminous bulb enclosing a luminous substance inside; and a sealing portion for retaining the airtightness of the luminous bulb, wherein the sealing portion has a first glass portion extending from the luminous bulb and a second glass portion provided at least in a portion of the inside of the first glass portion, the sealing portion further has a portion to which a compressive stress is applied, and a cavity is formed in a portion of the boundary between the first glass portion and the second glass portion in the sealing portion.

2. A high pressure discharge lamp comprising:

a luminous bulb enclosing a luminous substance inside; and a pair of sealing portions for retaining the airtightness of the luminous bulb, wherein each of the pair of sealing portions has a first glass portion extending from the luminous bulb and a second glass portion provided at least in a portion of the inside of the first glass portion, each of the pair of sealing portions further has a portion to which a compressive stress is applied, a pair of electrode rods are opposed in the luminous bulb, each of the pair of electrode rods is connected to a metal foil, the metal foil is provided in the sealing portion and at least a connection portion of the metal foil to the electrode rod is positioned in the second glass portion, and when the second glass portion is divided into a forward portion, a backward portion, and a central portion positioned between the forward portion and the backward portion under the assumption that the side of the second glass portion closer to the head of the electrode rod is the forward side, a cavity containing at least a rare gas is formed in a boundary portion between at least a portion of the central portion of the second glass portion and the first glass portion.

3. The lamp of claim 2, wherein when the sealing portion is measured by a sensitive color plate method utilizing a photoelastic effect, a portion to which a compressive stress is applied is present at least in a region of the sealing portion made of the second glass, and the compressive stress value in the longitudinal direction of the side tube portion is from 10 kgf/cm$^2$ to 50 kgf/cm$^2$ inclusive.

4. The lamp of claim 2, wherein the second glass portion covers the entire metal foil.

5. The lamp of claim 1, wherein the first glass contains 99 wt % or more of $SiO_2$, and the second glass contains $SiO_2$ and at least one of 15 wt % or less of $Al_2O_3$ and 4 wt % or less of B.

6. The lamp of claim 2, wherein the first glass contains 99 wt % or more of $SiO_2$, and the second glass contains $SiO_2$ and at least one of 15 wt % or less of $Al_2O_3$ and 4 wt % or less of B.

7. The lamp of claim 1, wherein the high pressure discharge lamp is a high pressure mercury lamp, and mercury is enclosed as the luminous substance in an amount of 150 mg/cm$^3$ or more based on the internal volume of the luminous bulb.

8. The lamp of claim 2, wherein the high pressure discharge lamp is a high pressure mercury lamp, and mercury is enclosed as the luminous substance in an amount of 150 mg/cm$^3$ or more based on the internal volume of the luminous bulb.

9. The lamp of claim 1, wherein an antenna of conductive material is disposed around a portion of the sealing portion including the cavity.

10. The lamp of claim 2, wherein an antenna of conductive material is disposed around a portion of the sealing portion including the cavity.

11. A lamp unit comprising the high pressure discharge lamp of claim 1 and a reflecting mirror for reflecting light emitted from the high pressure discharge lamp.

12. A lamp unit comprising the high pressure discharge lamp of claim 2 and a reflecting mirror for reflecting light emitted from the high pressure discharge lamp.

* * * * *